US012616348B2

(12) United States Patent
Yang

(10) Patent No.: US 12,616,348 B2
(45) **Date of Patent: *May 5, 2026**

(54) HANDHELD CLEANING DEVICE

(71) Applicant: Beijing Roborock Technology Co., Ltd., Haidian District (CN)

(72) Inventor: Yunlong Yang, Haidian District (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/197,707

(22) Filed: May 15, 2023

(65) Prior Publication Data

US 2023/0284856 A1 Sep. 14, 2023

Related U.S. Application Data

(63) Continuation of application No. 17/698,138, filed on Mar. 18, 2022, now Pat. No. 11,672,398, which is a (Continued)

(30) Foreign Application Priority Data

Apr. 29, 2021 (CN) ..... 202110474030.6

(51) Int. Cl.
*A47L 11/30* (2006.01)
*A46B 13/00* (2006.01)
(Continued)

(52) U.S. Cl.
CPC ..... *A47L 11/302* (2013.01); *A46B 13/001* (2013.01); *A46B 13/02* (2013.01);
(Continued)

(58) Field of Classification Search
CPC ..... A47L 11/302; A47L 11/4011; A47L 11/4019; A47L 11/4041; A47L 11/4069;
(Continued)

(56) References Cited

U.S. PATENT DOCUMENTS 9,851,720 B2 12/2017 Noh et al.
10,575,701 B2 3/2020 Conrad et al.
(Continued)

FOREIGN PATENT DOCUMENTS

CN 1767781 A 5/2006
CN 101516245 A 8/2009
(Continued)

OTHER PUBLICATIONS

CN113116242A Machine Translation Jul. 2021 (Year: 2021).*
(Continued)

*Primary Examiner* — Bryan R Muller
(74) *Attorney, Agent, or Firm* — Morgan, Lewis & Bockius LLP

(57) ABSTRACT

A handheld cleaning device includes a surface-moving portion and an upright portion. The surface-moving portion is in contact with a surface to be cleaned and is connected with the upright portion. The upright portion is configured to move the surface-moving portion in a case in which the surface-moving portion is in operation. The handheld cleaning device further includes a power battery configured to supply power to the handheld cleaning device. The surface-moving portion further includes at least two non-coaxial brushrolls configured to clean stains on the surface to be cleaned. The rotation speed of each brushroll is less than 3000 r/min.

16 Claims, 7 Drawing Sheets

Related U.S. Application Data continuation of application No. PCT/CN2021/116987, filed on Sep. 7, 2021.

(51) Int. Cl.
*A46B 13/02* (2006.01)
*A47L 11/40* (2006.01)

(52) U.S. Cl.
CPC ..... *A47L 11/4011* (2013.01); *A47L 11/4019* (2013.01); *A47L 11/4041* (2013.01); *A47L 11/4069* (2013.01); *A47L 11/4075* (2013.01); *A47L 11/4088* (2013.01); *A46B 2200/3033* (2013.01)

(58) Field of Classification Search
CPC ..... A47L 11/4075; A47L 11/4088; A47L 11/4044; A47L 11/4077; A47L 7/0009; A47L 7/0014; A47L 11/185; A47L 11/201; A46B 13/001; A46B 13/02; A46B 2200/3033; A46B 2200/30
See application file for complete search history.

(56) References Cited

U.S. PATENT DOCUMENTS

| | | | | |
|---|---|---|---|---|
| 10,912,436 | B2 * | 2/2021 | Li | A47L 11/4041 |
| 11,266,285 | B2 * | 3/2022 | Pruiett | A47L 11/4088 |
| 11,672,398 | B2 * | 6/2023 | Yang | A47L 11/4077 15/319 |
| 2017/0215678 | A1 | 8/2017 | Moser et al. | |
| 2019/0000292 | A1 * | 1/2019 | Rufenach | A47L 11/292 |
| 2019/0246860 | A1 | 8/2019 | Li | |

FOREIGN PATENT DOCUMENTS

| | | | | | |
|---|---|---|---|---|---|
| CN | 202020380 | U | | 11/2011 | |
| CN | 101516245 | B | | 1/2012 | |
| CN | 106793911 | A | | 5/2017 | |
| CN | 206434268 | U | | 8/2017 | |
| CN | 107920705 | A | | 4/2018 | |
| CN | 108420370 | A | | 8/2018 | |
| CN | 108471917 | A | | 8/2018 | |
| CN | 108888177 | A | | 11/2018 | |
| CN | 208910073 | U | | 5/2019 | |
| CN | 209404608 | U | | 9/2019 | |
| CN | 110353564 | A | | 10/2019 | |
| CN | 111093448 | A | * | 5/2020 | A47L 11/4013 |
| CN | 111166251 | A | | 5/2020 | |
| CN | 111358381 | A | | 7/2020 | |
| CN | 211749300 | U | | 10/2020 | |
| CN | 211933874 | U | | 11/2020 | |
| CN | 212140337 | U | | 12/2020 | |
| CN | 112515559 | A | | 3/2021 | |
| CN | 212913093 | U | | 4/2021 | |
| CN | 113116242 | A | * | 7/2021 | A47L 11/302 |
| JP | S53-138470 | U | | 11/1978 | |
| JP | H06-327591 | A | | 11/1994 | |
| JP | H09-047403 | A | | 2/1997 | |
| JP | 2016-131575 | A | | 7/2016 | |
| JP | 2019-115789 | A | | 7/2019 | |
| JP | 2014-145612 | A | | 9/2020 | |
| JP | 2020-145612 | A | | 9/2020 | |
| KR | 20110011156 | U | | 12/2011 | |
| KR | 20-2020-0002122 | U | | 9/2020 | |
| RU | 2511487 | C2 | | 4/2014 | |
| SU | 55658 | A1 | | 11/1939 | |
| TW | 201731434 | A | | 9/2017 | |
| WO | 2014/137168 | A1 | | 9/2014 | |
| WO | 2020/132482 | A1 | | 6/2020 | |
| WO | 2020/207603 | A1 | | 10/2020 | |
| WO | 2020/228516 | A1 | | 11/2020 | |

OTHER PUBLICATIONS

CN111093448A Machine Translation May 2020 (Year: 2020).*
International Search Report issued in related International Patent Application No. PCT/CN2021/116987 dated Dec. 2, 2021.
Office Action issued in related Chinese Patent Application No. 202111239385.3 dated May 31, 2022.
Office Action dated Jul. 11, 2023, issued in related Taiwanese Patent Application No. 11220673820.
Patent Right Evaluation Report issued in the corresponding Chinese Application No. 202220864975.9, mailed Dec. 8, 2023.
Office Action issued in corresponding Japanese Patent Application No. 2023-566609, dated Sep. 10, 2024.
Extended European Search Report issued in corresponding European Patent Application No. 21938832.9, dated Mar. 14, 2025.
Office Action issued in corresponding Korean Patent Application No. 10-2023-7039684, dated Sep. 29, 2025.

* cited by examiner

HANDHELD CLEANING DEVICE

CROSS-REFERENCE TO RELATED APPLICATION

The present application is a Continuation Application of U.S. patent application Ser. No. 17/698,138, which is a Continuation Application of a PCT Application under PCT/CN2021/116987 filed on Sep. 7, 2021 claiming the priority of Chinese Patent Application No. 202110474030.6 filed on Apr. 29, 2021; the disclosures of all above are incorporated herein by reference in their entireties as a part of the present application for all purposes.

TECHNICAL FIELD

Embodiments of the present disclosure relate to a handheld cleaning device.

BACKGROUND

Existing intelligent cleaning machines can absorb sewage and then collect it while cleaning the ground, which has advantages including being friendly to the environment, saving energy, and being highly efficient, etc. Although intelligent cleaning machines have been widely used in various scenarios, brushrolls of the existing intelligent cleaning machines have single structures, which results in poor cleaning effect and poor user experience.

SUMMARY

According to an aspect of the present disclosure, there is provided a handheld cleaning device, including a surface-moving portion and an upright portion. The surface-moving portion is configured to be in contact with a surface to be cleaned and is connected with the upright portion. The upright portion is configured to move the surface-moving portion. The handheld cleaning device further includes a power battery configured to supply power to the handheld cleaning device. The surface-moving portion further includes at least two brushrolls that are disposed non-coaxially and are configured to clean stains on the surface to be cleaned. The rotation speed of each of the at least two brushrolls is less than 3000 r/min.

In some embodiments of the present disclosure, the surface-moving portion further includes at least two wipers, which correspond to the at least two brushrolls respectively; as to a wiper and a brushroll which correspond to each other, the wiper is disposed close to or in contact with a circumference of the brushroll, and is configured to wipe off cleaning liquid or stains remaining on the circumference of the brushroll.

In some embodiments of the present disclosure, the wiper is located above the respective brushroll.

In some embodiments of the present disclosure, the wiper includes a stain sub-wiper, configured to wipe off the cleaning liquid or the stains remaining on the circumference of the brushroll.

In some embodiments of the present disclosure, the wiper further includes a liquid retaining sub-wiper, configured to enable the cleaning liquid to fully contact the brushroll.

In some embodiments of the present disclosure, the wiper is arranged at an angle with respect to the circumference of the brushroll, and is in interference contact with the circumference of the brushroll.

In some embodiments of the present disclosure, the surface-moving portion further includes a fluid distributor. The fluid distributor includes a fluid inlet, a fluid distribution channel and at least two fluid outlets. The fluid inlet is connected with a liquid supply pipe, and the fluid distribution channel distributes inflowing fluid to the at least two fluid outlets.

In some embodiments of the present disclosure, the upright portion further includes a stain collector. The stain collector includes a collection tank and at least one suction channel. Each of the at least one suction channel has a first end connected to the collection tank, and a second end arranged on a side of the brushrolls away from the surface to be cleaned, or arranged at a position close to the surface to be cleaned, so as to collect the stains into the collection tank via the suction channel.

In some embodiments of the present disclosure, the surface-moving portion further includes at least two drive gearboxes, configured to be in transmission connection with the at least two brushrolls respectively so as to drive the at least two brushrolls respectively to rotate.

In some embodiments of the present disclosure, the handheld cleaning device further includes a control circuit, configured to control the handheld cleaning device; and a posture sensor connected to the control circuit, and configured to sense movement direction information of the handheld cleaning device and to transmit the movement direction information to the control circuit.

In some embodiments of the present disclosure, the posture sensor includes a six-axis sensor.

In some embodiments of the present disclosure, the at least two brushrolls include a front brushroll and a rear brushroll. The front brushroll and the rear brushroll are arranged in parallel on a horizontal plane, and the front brushroll and the rear brushroll are configured to rotate circumferentially in different directions, to take garbage on the surface to be cleaned into a gap between the front brushroll and the rear brushroll.

In some embodiments of the present disclosure, the control circuit is configured to control the rotation speed of the front brushroll to be greater than the rotation speed of the rear brushroll, in a case in which the movement direction information indicates a forward movement; and control the rotation speed of the rear brushroll to be greater than the rotation speed of the front brushroll, in case the movement direction information indicates a backward movement.

In some embodiments of the present disclosure, one of the at least two brushrolls includes a first brushroll part and a second brushroll part that are arranged coaxially, both the first brushroll and the second brushroll are connected to a drive mechanism. The drive mechanism includes a first motor, a belt and a driven shaft; the belt is connected with both the first motor and the driven shaft; the driven shaft is provided at a position where the first brushroll part and the second brushroll part are close to each other; the driven mechanism further includes a rotating rod, which is arranged coaxially with the driven shaft and is extended from the driven shaft in respective axis directions of the driven shaft, and the first brushroll part and the second brushroll part are sleeved on the rotating rod respectively; and the first motor drives the belt to rotate, which in turn drives the first brushroll part and the second brushroll part to rotate.

In some embodiments of the present disclosure, the handheld cleaning device further includes a liquid level sensor, installed on at least one of a cleaning liquid tank, a collection tank and a liquid supply pipe of the handheld cleaning device, the liquid level sensor is connected with the control circuit, and is configured to sense liquid level information of the handheld cleaning device and to transmit the liquid level information to the control circuit.

LIST OF REFERENCE NUMERALS

Figure 1:
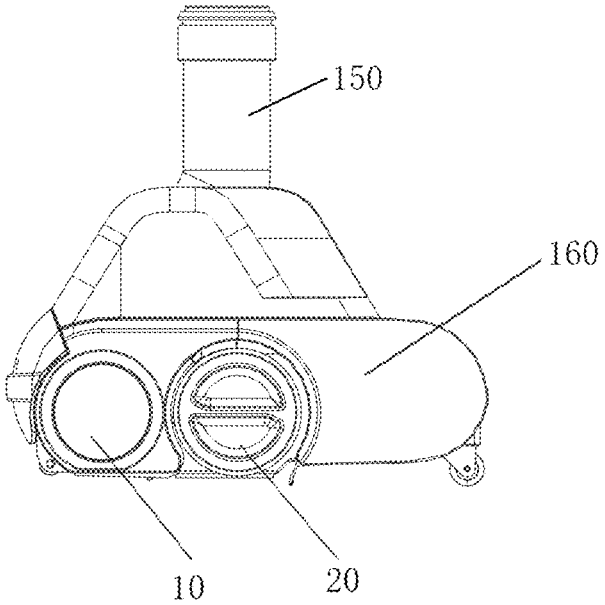
FIG. 1 illustrates a schematic view of a handheld cleaning device according to an embodiment of the present disclosure.

10—front brushroll; 20—rear brushroll; 201—first brushroll part; 202—second brushroll part; 30—suction channel; 40—drive gearbox; 50—upper wiper; 501—first wiper; 5011—first stain sub-wiper; 5012—first liquid retaining sub-wiper; 502—second wiper; 5021—second stain sub-wiper; 5022—second liquid retaining sub-wiper; 60—lower wiper; 70—housing; 701—escape opening; 80—brushroll drive circuit; 90—collection tank; 100—posture sensor; 110—belt; 120—wheel; 130—liquid supply pipe; 1301—liquid distribution pipe; 1302—liquid guide pipe; 140—side wall; 150—upright portion; 160—surface-moving portion; 170—flow guide plate; 180—fluid distributor; 1801—fluid outlet; 1802—fluid inlet; 1803—fluid distribution channel; 1804—inlet of fluid distribution channel; 190—rotating rod; 200—control circuit; 210—pump; 220—cleaning liquid tank; 230—contact portion; and 240—connection portion.

DETAILED DESCRIPTION

To render the purposes, technical solutions, and advantages of the present disclosure more clear, the present disclosure is further described in detail below in conjunction with specific embodiments and with reference to accompanying drawings. It should be understood that these descriptions are only exemplary and are not intended to limit the scope of the present disclosure. In addition, in the following description, the description of well-known structures and techniques is omitted to avoid unnecessary confusion of the concept of the present disclosure.

Schematic views of a layer structure according to embodiments of the present disclosure are illustrated in the accompanying drawings. These drawings are not drawn to scale, and some details may be omitted. The shapes of various regions and layers illustrated in the drawings, as well as the relative sizes and position relationship between them, are only exemplary. In practice, there may be deviations due to manufacturing tolerances or technical limitations, and those of ordinary skill in the art may additionally conceive of regions/layers with different shapes, sizes, and relative positions according to actual requirements.

It is obvious that the described embodiments are part of embodiments of the present disclosure, rather than all of them. All the other embodiments obtained without creative work by those of ordinary skill in the art, based on the described embodiments of the present disclosure, shall fall within the protection scope of the present disclosure.

In addition, the technical features involved in different embodiments of the present disclosure described below can be combined with each other as long as they do not conflict with each other.

The present disclosure will be described below in more detail with reference to the accompanying drawings. In each drawing, same elements are denoted by the same reference numerals. For clarity, each part in the drawings is not drawn to scale.

The present disclosure will be described in detail below with reference to the drawings and embodiments.

Figure 7:
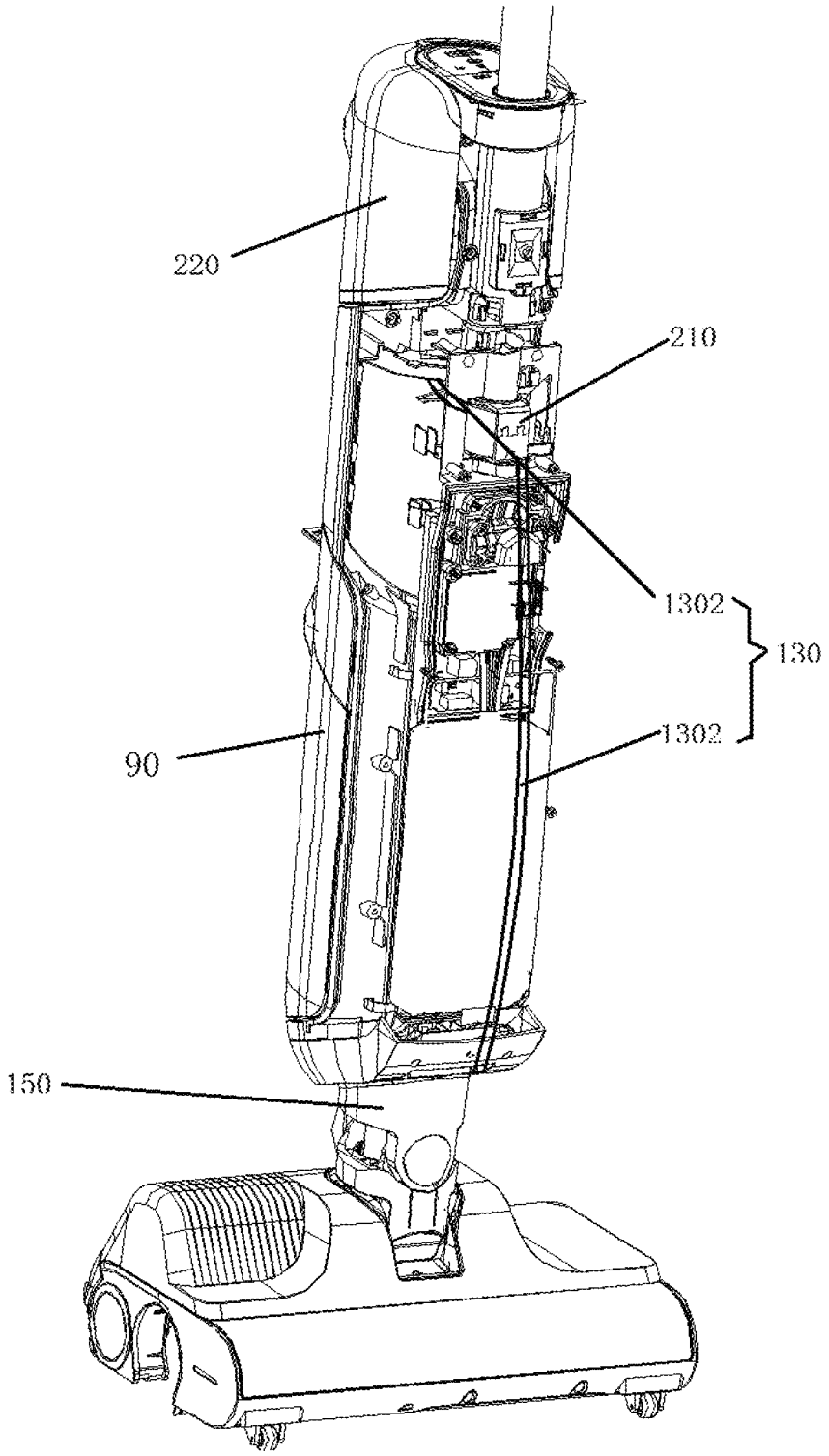
FIG. 7 illustrates an overall structural view of a handheld cleaning device according to an embodiment of the present disclosure.
Figure 8:
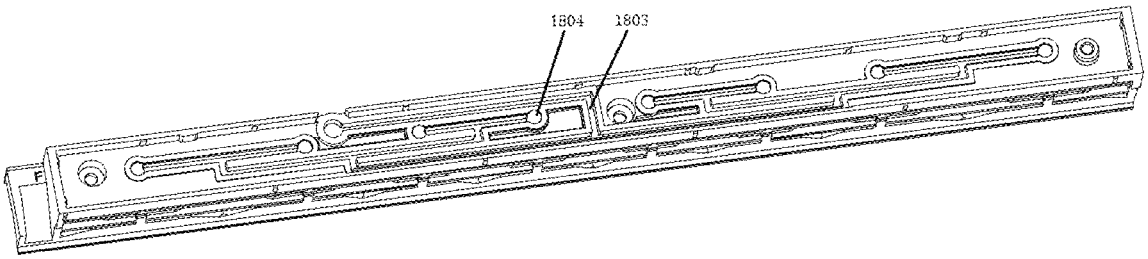
FIG. 8 illustrates an internal structural view of a fluid distributor according to an embodiment of the present disclosure.

An embodiment of the present disclosure relates to a brushroll. FIGS. 1 and 7 are schematic views of a handheld cleaning device according to an embodiment of the present disclosure. Referring to FIGS. 1 and 7, the handheld cleaning device includes a surface-moving portion 160 and an upright portion 150. The surface-moving portion 160 is configured to be in contact with a surface to be cleaned and connected to the upright portion 150. The upright portion 150 is configured to move the surface-moving portion 160 when the surface-moving portion 160 is in operation. An accommodation compartment that accommodates electrical devices and the like is further provided in the upright portion 150. The handheld cleaning device further includes a power battery configured to supply power to the handheld cleaning device. The cleaning objects of the handheld cleaning device include ceramic tiles, floors, cement floors, glass surfaces, and other surface objects with flat surfaces that can be cleaned with water.

During use of the handheld cleaning device, the upright portion 150 is inclined relative to the surface-moving portion 160. In this way, a downward force generated by the gravity of the upright portion 150 renders the surface-moving portion 160 in tight contact with the surface to be cleaned, which is convenient and thus more labor-saving for the user to push the surface-moving portion 160 to move by use of the upright portion 150. In a case in which the handheld cleaning device is placed on a charging station, the upright portion 150 is perpendicular to the surface-moving portion 160, thereby reducing the space occupied by the handheld cleaning device.

A wheel 120 is further arranged at a bottom part of the surface-moving portion 160. In an embodiment of the present disclosure, the wheel 120 is located at a rear end in a traveling direction of the surface-moving portion 160. In an embodiment of the present disclosure, two wheels 120 are provided respectively on a front end and a rear end of the surface-moving portion 160, so as to reduce the friction force between the bottom part of the surface-moving portion 160 and the surface to be cleaned. This thereby reduces the pushing and pulling force applied to the handheld cleaning device by the user and improves user experience.

The surface-moving portion 160 further includes at least two non-coaxial brushrolls, which are brushes with horizontal rotating axes and are configured to clean stains on the surface to be cleaned.

In an embodiment of the present disclosure, a front brushroll 10 and a rear brushroll 20 are provided, which are arranged in parallel on one horizontal plane. The front brushroll 10 and the rear brushroll 20 rotate in different directions, so as to collect garbage on the surface to be cleaned into the space between the front brushroll 10 and the rear brushroll 20. The rotation speed of each brushroll is less than a certain value, for example, less than 3000 r/min. If the rotation speed of the brushroll is too fast, such as more than 3000 r/min, the dirty liquid rolled up by the brushrolls from the surface to be cleaned is likely to be atomized, which may cause the handheld cleaning device to become dirty, and thereby affect the cleaning efficiency.

Since at least two brushrolls are arranged one behind the other on the surface-moving portion, during the actual use of the handheld cleaning device of the present disclosure, the handheld cleaning device may wipe the ground twice by a single push or pull-back action by the user. This greatly improves the cleaning efficiency as compared with existing handheld cleaning devices that are provided with only one brushroll. In addition, since there are arranged at least two brushrolls, that is, there are required at least two gearboxes and drive motors correspondingly, the weight of the whole surface-moving portion is greater than that of the existing handheld cleaning device with a single brushroll. This ensures that the handheld cleaning device can generate a greater pressure on the surface to be cleaned during use, thus improving effectively the cleaning strength of the handheld cleaning device against stubborn stains.

The handheld cleaning device according to an embodiment of the present disclosure is configured to clean the stains on the surface to be cleaned. FIG. 1 illustrates a front view of the handheld cleaning device with the brushrolls installed on the surface-moving portion 160. While the handheld cleaning device is used to clean stains, the front brushroll 10 and the rear brushroll 20 rotate in different directions. If the handheld cleaning device is placed as illustrated in FIG. 1, that is, the front brushroll 10 is located on the left side of the rear brushroll 20, then the front brushroll 10 rotates counterclockwise and the rear brushroll 20 rotates clockwise. If the handheld device is placed opposite to what is illustrated in FIG. 1, that is, the front brushroll 10 is located on the right side of the rear brushroll 20, then the front brushroll 10 rotates clockwise and the rear brushroll 20 rotates counterclockwise. Alternatively, a contact point of the front brushroll 10 with the surface to be cleaned rotates in a direction toward the rear brushroll 20, and a contact point of the rear brushroll 20 with the surface to be cleaned rotates in a direction toward the front brushroll 10. This renders the stains on the surface to be cleaned to be finally collected between the front brushroll 10 and the rear brushroll 20, and then enter a collection tank 90 via an inlet of a suction channel 30 located above a gap between the front brushroll 10 and the rear brushroll 20, so as to achieve cleaning and collection of the stains.

Figure 5:
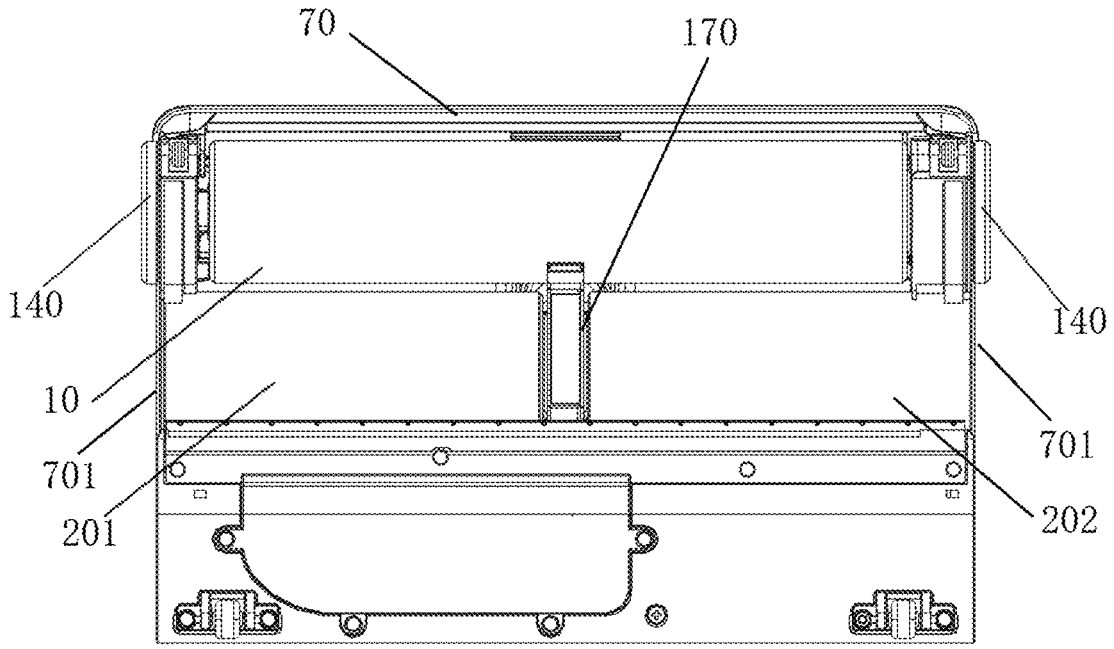
FIG. 5 illustrates a schematic cross-sectional structural view of a handheld cleaning device according to an embodiment of the present disclosure.
Figure 6:
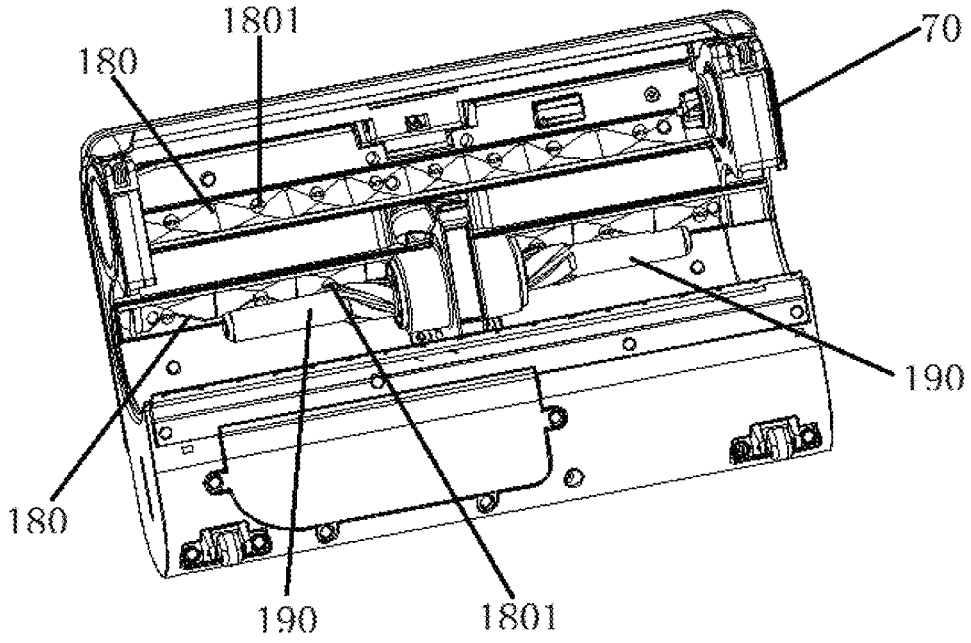
FIG. 6 illustrates a structural view of a housing, a rotating rod, and a fluid distributor in the surface-moving portion according to an embodiment of the present disclosure.
Figure 10:
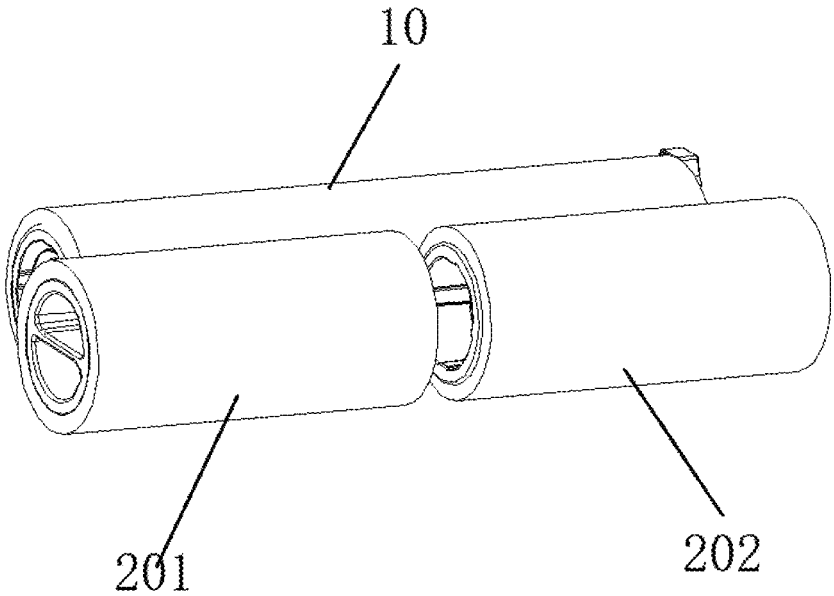
FIG. 10 illustrates a structural view of a front brushroll, a first brushroll part and a second brushroll part according to an embodiment of the present disclosure.

As illustrated in FIGS. 5, 6 and 10, according to an embodiment of the present disclosure, there are at least two non-coaxial brushrolls. One of the front brushroll 10 and the rear brushroll 20 includes a first brushroll part 201 and a second brushroll part 202 that are coaxially arranged. In an embodiment of the present disclosure, the rear brushroll 20 including two brushroll parts is taken as an example for description. As illustrated in FIGS. 5 and 6, both the first brushroll part 201 and the second brushroll part 202 are connected to a drive mechanism. The drive mechanism includes a first motor, a belt 110, and a driven shaft. The belt 110 is connected with both the first motor and the driven shaft, and the driven shaft is arranged between the first brushroll part 201 and the second brushroll part 202 (as illustrated in FIG. 5). The driven mechanism further includes a rotating rod, which is arranged coaxially with the driven shaft and is extended from the driven shaft in respective axis directions of the driven shaft, and the first brushroll part 201 and the second brushroll part 202 are sleeved on the rotating rod 190, respectively. Thus, as driven by the first motor, the belt 110 drives the first brushroll part 201 and the second brushroll part 202 to rotate. In an embodiment of the present disclosure, the rear brushroll 20 is divided into a first brushroll part 201 and a second brushroll part 202 that are coaxially arranged and are sleeved on the rotating rod 190. For subsequent replacement and maintenance, the first brushroll part and the rear brushroll part can be easily detached, and it is not required to replace the entire brushroll, which saves costs.

Figure 2:
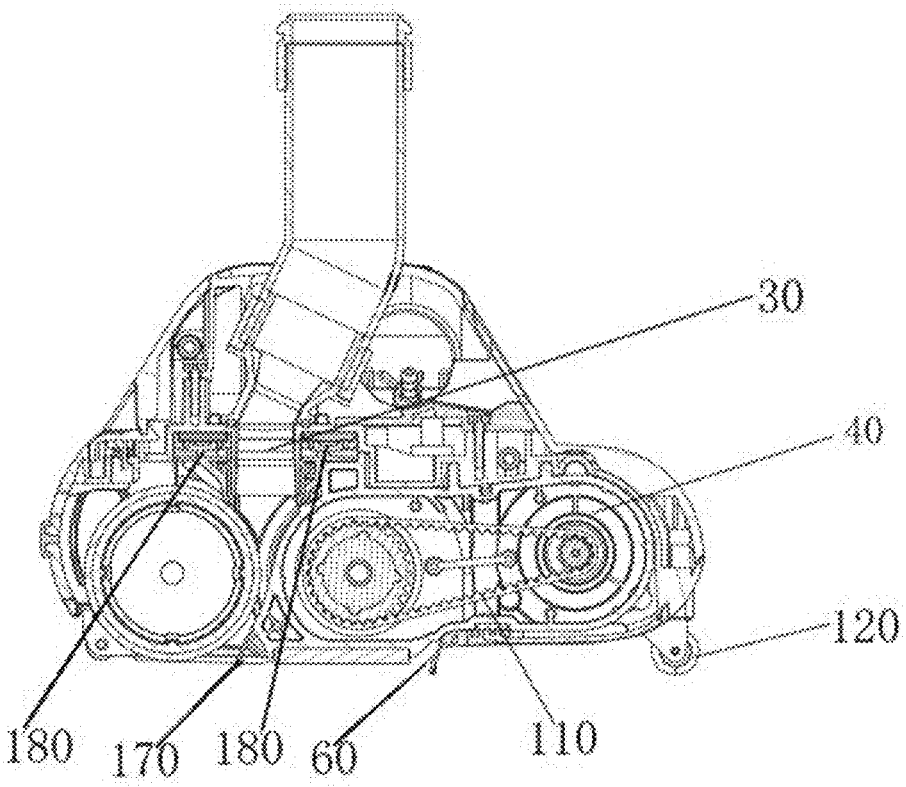
FIG. 2 illustrates a schematic cross-sectional structural view of a handheld cleaning device according to an embodiment of the present disclosure.

Further, as illustrated in FIGS. 2 and 5, a flow guide plate 170 is arranged at a gap between the first brushroll part 201 and the second brushroll part 202, and a lower portion of the flow guide plate 170 is inclined gradually in a direction away from the first brushroll part 201 and the second brushroll part 202. Exemplarily, the rear brushroll 20 includes a first brushroll part 201 and a second brushroll part 202. The front brushroll 10 is formed as an integral brushroll part. The flow guide plate 170 is arranged at the gap between the first brushroll part 201 and the second brushroll part 202. The lower portion of the flow guide plate 170 is inclined gradually in a direction away from the first brushroll part 201 and the second brushroll part 202, that is, inclined in a direction approaching the front brushroll 10.

In practical applications, in a case in which the two brushrolls rotate to clean the stains, the flow guide plate 170 can prevent the stains from entering the gap between the first brushroll part 201 and the second brushroll part 202. Therefore, it is avoided that the stains accumulate in the gap to hinder transmission operation between the rotating rod 190 and the belt 110. In addition, the stains on the flow guide plate 170 can reach an inlet of a suction channel 30 along the flow guide plate 170 by a suction force of the suction channel 30, and enter the collection tank 90 via the inlet and the suction channel 30. Thereby, it is avoided that the stains are kept remained on the flow guide plate 170, thus improving the effectiveness of stain collection. The first brushroll part 201 and the second brushroll part 202 rotate in the same direction at the same time.

As illustrated in FIGS. 5, 6 and 10, one of the front brushroll and the second brushroll is configured to include two brushroll parts that are coaxially arranged, namely, the first brushroll part 201 and the second brushroll part 202. The first brushroll part 201 and the second brushroll part 202 are sleeved on the rotating rod 190, respectively. The rotating rod 190 is arranged coaxially with the driven shaft, which is disposed between the two brushroll parts and is driven by the first motor via the belt 110. With such structure, the first brushroll part 201 and the second brushroll part 202 may be installed on the rotating rod 190 from both sides of the surface-moving portion 160. This ensures that ends of the two brushroll parts are flush with side walls of the surface-moving portion 160, respectively, after the first brushroll part 201 and the second brushroll part 202 are installed in place. Therefore, during the operation of the handheld cleaning device, it is convenient to clean joints between corners, wall edges, furniture, walls and the like, without frequently adjusting the operation direction of the handheld cleaning device in order to clean narrow spaces such as the joints between corners, wall edges, furniture, walls and the like, which improve cleaning efficiency and user experience.

In addition, the first brushroll part 201 and the second brushroll part 202 are installed by being sleeved on the rotating rod 190 from respective sides or detached from the rotating rod 190 from respective sides. By contrast, an existing brushroll is typically installed on or detached from the surface-moving portion 160 by engagement mechanisms that are mutually matched at one end thereof, which typically requires a detachable top cover. In that case, when installing the brushroll, the top cover is opened first, then the brushroll is installed, and finally the top cover is covered. Therefore, operation of such installation or detachment is cumbersome and affects user experience. Whereas, according to an embodiment of the present disclosure, the first brushroll part 201 and the second brushroll part 202 are installed by being sleeved on the rotating rod 190 from respective sides, and the first and second brushroll parts can be removed easily. For example, the first brushroll part 201 may be firstly sleeved on the rotating rod 190, and then the first brushroll 201 may be rotated relative to the rotating rod 190. Thus, with the help of engagement of an inner surface of the first brushroll part 201 with a mechanism on the rotating rod 190, the first brushroll part 201 is fixed. The second brushroll part 202 may be installed with a similar installation structure. It can be seen that such structure greatly improves the convenience of installation and detachment of the brushrolls and facilitates subsequent maintenance of the handheld cleaning device. In an embodiment of the present disclosure, an escape opening 701 is provided in a side wall of a housing 70 at a position corresponding to an end of at least one brushroll. An end of the brushroll part is extended to the escape opening 701 in the side wall and is flush with the side wall 140.

Exemplarily, as illustrated in FIG. 5, the rear brushroll 20 includes a first brushroll part 201 and a second brushroll part 202. Axes of the first brushroll part 201 and the second brushroll part 202 coincide with each other. In this case, one end of the first brushroll part 201 away from the second brushroll part 202 extends to the escape opening 701 in a side wall of the housing 70 and is flush with the side wall 140. In addition, one end of the second brushroll part 202 away from the first brushroll part 201 extends to the escape opening 701 in a side wall of the housing 70 and is flush with the side wall 140.

The end of the brushroll extends to the escape opening 701 and is flush with the side wall 140. In this way, during operation of the handheld cleaning device, it is convenient to clean corners, wall edge, adjoining areas between furniture and walls, or the like, without frequently adjusting moving directions of the handheld cleaning device in order to clean narrow spaces such as the joints between corners, wall edges, furniture, walls and the like, which is conducive to improving cleaning efficiency and user experience. In an embodiment of the present disclosure, the handheld cleaning device further includes a stain collector, which is configured to draw the dirty liquid on the surface to be cleaned or the brushrolls into the stain collector via a sewage pipe for dirty liquid with the help of a suction force provided by a fan. This helps to achieve the function of collecting the dirty liquid, i.e., collecting the dirty liquid generated after cleaning the surface to be cleaned. For example, the stain collector can achieve collection of the dirty liquid through suctioning the dirty liquid by a suction nozzle that is driven by a fan.

The stain collector includes a collection tank 90 and at least one suction channel 30 and is configured to collect stains accommodated between the front brushroll 10 and the rear brushroll 20 or the stains on the surface to be cleaned. FIG. 2 illustrates a schematic cross-sectional structural view of the handheld cleaning device according to an embodiment of the present disclosure. Referring to FIGS. 2 and 7, the suction channel 30 is arranged away from the surface to be cleaned and has an inlet and an outlet. The inlet of the suction channel 30 is arranged above a gap between the front brushroll 10 and the rear brushroll 20 and is disposed opposite to the stains accommodated between the front brushroll 10 and the rear brushroll 20. The outlet of the suction channel 30 is connected to the collection tank 90, which is also in fluid communication with the fan. The fan is configured to generate a negative pressure for suctioning stains from the inlet of the suction channel 30 into the collection tank 90, so as to collect stains.

As illustrated in FIGS. 2 and 7, the stain collector includes a collection tank 90 and at least one suction channel 30. The suction channel 30 is arranged close to the surface to be cleaned and has an inlet and an outlet. The inlet of the suction channel 30 is arranged above the surface to be cleaned. The outlet of the suction channel 30 is connected to the collection tank 90 that is also in fluid communication with a fan. The fan is configured to generate a negative pressure for suctioning stains from the inlet of the suction channel 30 into the collection tank 90, in order to collect stains.

The stain collector further includes at least one suction nozzle. An amount and a size of the at least one suction nozzle are matched with an amount and a size of the inlets of the suction channel 30, respectively, so that the at least one suction nozzle can be assembled at the inlets of the suction channel 30. The at least one suction nozzle is arranged above the gap between the front brushroll 10 and the rear brushroll 20. Alternatively, the at least one suction nozzle is arranged above the surface to be cleaned. The at least one suction nozzle is configured to suction the dirty liquid between the front brushroll 10 and the rear brushroll 20 or the dirty liquid on the surface to be cleaned. The dirty liquid suctioned is delivered into the collection tank 90 via the suction channel 30. The suction channel 30 may be a rigid tube extending along a path, or may be a hose whose path may change, which may be selected according to the type and the structural scheme of the handheld cleaning device.

Therefore, the handheld cleaning device according to an embodiment of the present disclosure may not only clean the surface to be cleaned, but may also collect the stains after cleaning at the same time.

As illustrated in FIGS. 6, 7, 8 and 9, the handheld cleaning device according to an embodiment of the present disclosure further includes a fluid distributor 180, configured to distribute cleaning liquid to various brushrolls or the surface to be cleaned. The fluid distributor 180 is a device that can control the cleaning liquid. The cleaning liquid includes any one of clean water, a cleaning agent, or a mixture of clean water and a cleaning agent. The fluid distributor 180 can spray the liquid onto the surface to be cleaned, and then clean the surface to be cleaned through the brushrolls. The fluid distributor 180 includes a fluid inlet 1802, a fluid distribution channel 1803, and at least two fluid outlets 1801. The fluid inlet 1802 is connected with a liquid supply pipe 130, and the fluid distribution channel 1803 distributes inflowing fluid to the at least two fluid outlets 1801.

In an embodiment of the present disclosure, all the fluid outlets 1801 are spaced apart at an equal spacing, so that final output cleaning liquid is evenly applied to the brushrolls or the surface to be cleaned. The fluid inlet 1802 is in communication with the inlet 1804 of each fluid distribution channel 1803, so that the cleaning liquid is delivered to each fluid distribution channel 1803. In addition, the outlet of each fluid distribution channel 1803 is in communication with a respective fluid outlet 1801, and the distance from the inlet 1804 to the outlet in each fluid distribution channel is the same. In this case, the frequencies and amounts of the cleaning water that the fluid outlets 1801 output are consistent with each other, thereby ensuring that the fluid distributor 180 evenly distributes the cleaning liquid to the brushrolls or the surface to be cleaned.

The liquid supply pipe 130 is arranged away from the surface to be cleaned and is located above the front brushroll 10 and the rear brushroll 20. A first end of the liquid supply pipe 130 is connected to a cleaning liquid tank 220, and a second end of the liquid supply pipe 130 is situated on a side of the brushrolls away from the surface to be cleaned and is in communication with a fluid inlet 1802 of the fluid distributor 180. Finally, the cleaning liquid is delivered to the brushrolls or the surface to be cleaned. The liquid supply pipe 130 may be a rigid tube extending along a path or may be a hose whose path may be changed, which may be selected according to the type and the structural scheme of the handheld cleaning device.

As illustrated in FIGS. 3, 7, 8 and 9, the liquid supply pipe 130 includes a liquid guide pipe 1302 and at least two liquid distribution pipes 1301. An end of the liquid guide pipe 1302 is connected to the cleaning liquid tank 220, and the other end of the liquid guide pipe 1302 is shunted, so that the other end of the liquid guide pipe 1302 is in communication with the two liquid distribution pipes 1301. Output ends of the two liquid distribution pipes 1301 are located above the front brushroll 10 and the rear brushroll 20 respectively. Therefore, the cleaning liquid can be delivered to the front brushroll 10 and the rear brushroll 20.

In an embodiment of the present disclosure, at least two liquid distribution pipes 1301 are adopted, thus enabling the cleaning liquid to be shunted, so as to increase the spraying area of the cleaning liquid, and thereby improve comprehensiveness and efficiency of spraying the cleaning liquid.

In an embodiment of the present disclosure, the output end of the liquid distribution pipe 1301 is further provided with at least one nozzle. The cleaning liquid tank 220 is connected to the nozzle via the liquid distribution pipe 1301. Thus, the cleaning fluid in the cleaning liquid tank 220 is delivered to the nozzle via the liquid distribution pipe 1301, and in turn the cleaning fluid is sprayed to the front brushroll 10, the rear brushroll 20 and/or the surface to be cleaned.

In a specific application, the nozzle can improve the spraying area and the spraying uniformity of the cleaning liquid. The number of nozzles may be chosen according to the overall length of the front brushroll 10 and the rear brushroll 20. The distance between two adjacent nozzles is the same, thereby ensuring that the cleaning liquid can be sprayed to all parts of the brushrolls.

Figure 9:
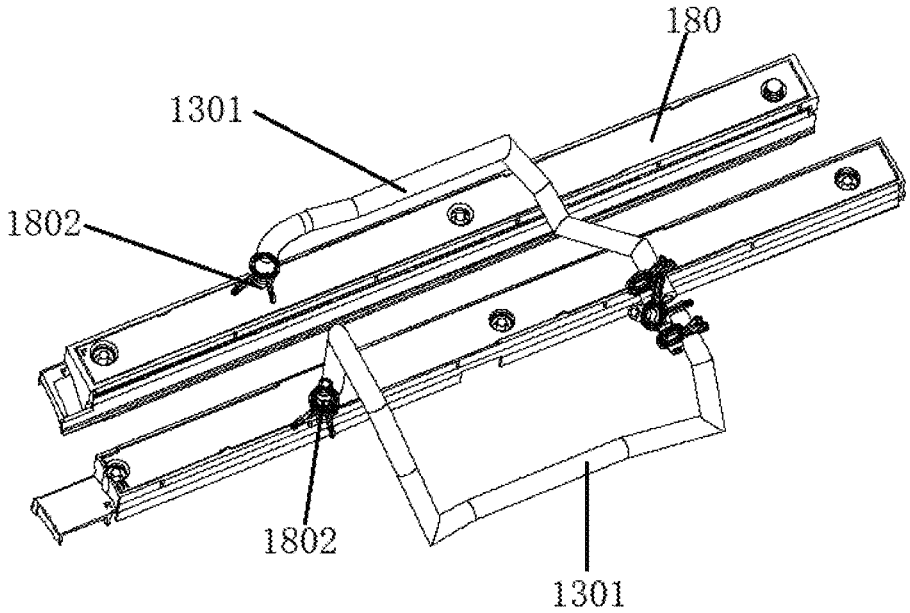
FIG. 9 illustrates a structural view of a liquid distributive pipe and a fluid distributor according to an embodiment of the present disclosure.

In an embodiment of the present disclosure, as illustrated in FIG. 7, a pump 210 is connected between the liquid guide pipe 1302 and the cleaning liquid tank 220. The pump 210 suctions the cleaning liquid from the cleaning liquid tank 220 into the liquid guide pipe 1302, and the liquid guide pipe 1302 further shunts the cleaning liquid into the two liquid distribution pipes 1301 (as shown in FIG. 9). The pump 210 increases a flow rate of the cleaning liquid and shortens time for the cleaning liquid to flow to the liquid distribution pipes 1301, thereby improving the work efficiency of the handheld cleaning device.

In an embodiment of the present disclosure, the liquid supply pipe 130 includes four liquid distribution pipes 1301. Output ends of two liquid distribution pipes 1301 are located at both ends of the front brushroll 10, and output ends of the other two liquid distribution pipes 1301 are located at both ends of the rear brushroll 20. This helps to evenly distribute the cleaning liquid onto the front brushroll 10 and the rear brushroll 20.

Each brushroll is provided with two liquid distribution pipes 1301, so that the cleaning liquid is sprayed on the same brushroll at the same time via the two liquid distribution pipes 1301, thereby improving the spray efficiency of the cleaning liquid. Moreover, output ends of the two liquid distribution pipes 1301 are located at both ends of the brushroll, which also reduces or avoids the overlapping between the spraying areas of the two liquid distribution pipes 1301 and improves the spraying uniformity.

Figure 3:
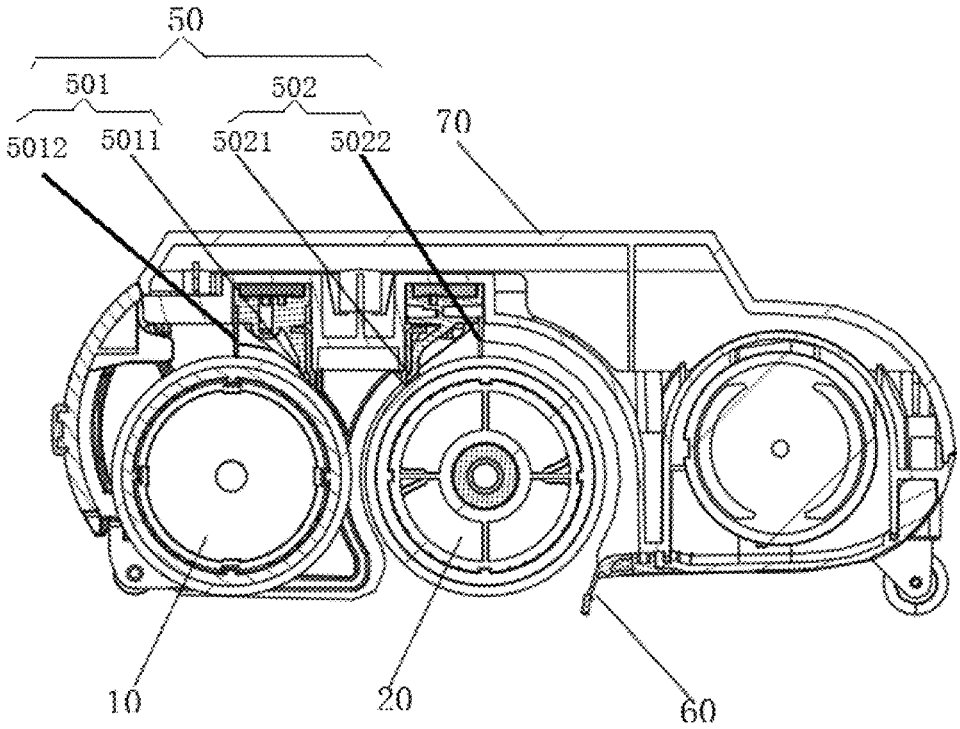
FIG. 3 illustrates a schematic cross-sectional view of a surface-moving portion according to an embodiment of the present disclosure.

As illustrated in FIGS. 2 and 3, the handheld cleaning device according to an embodiment further includes at least one wiper. Each of the at least one wiper abuts a circumference of the respective brushrolls and is configured to wipe off the cleaning liquid or stains remaining on the circumference of the brushrolls. Alternatively, each wiper is arranged to abut the circumference of the respective brushroll and is in contact with the surface to be cleaned, and configured to wipe off the cleaning liquid or stains remaining on the circumference of the brushrolls and wipe off the cleaning liquid or stains remaining on the surface to be cleaned.

The wiper can wipe off the cleaning fluid or stains remaining on the circumference of the brushrolls, as well as the cleaning fluid or stains remaining on the surface to be cleaned. This improves the cleanliness of the brushrolls and avoids secondary pollution to the cleaning surface caused by the stains or excessive cleaning fluid on the brushrolls being thrown out due to a centrifugal force. In addition, the wiper can assist the brushrolls in cleaning the surface to be cleaned, thereby improving the cleaning effect.

The wiper is arranged at a certain angle with respect to the circumference of the respective brushroll and is in interference contact with the circumference of the brushroll.

The wiper is arranged at a certain angle with respect to the circumference of the respective brushroll, which helps to increase the resistance of the wiper to the brushroll and thereby improve the wiping effect of the brushrolls. The interference contact enables the wiper to tightly abut the circumference of the brushrolls, which provides better cleaning of the stains or cleaning liquid attached to the circumference of the brushrolls, and further improves the cleaning effect of the brushrolls.

The wiper is located above the brushrolls. In a case in which the wiper is situated at the circumference of the brushroll, and is configured to remove the cleaning fluid or stains remaining on the circumference of the brushroll, the wiper is located above the front brushroll 10 and the rear brushroll 20, i.e., the wiper is an upper wiper 50. FIG. 3 illustrates a schematic cross-sectional view of the surface-moving portion according to an embodiment of the present disclosure. Referring to FIG. 3, an upper wiper 50 is installed on the circumference of each of the front brushroll 10 and the rear brushroll 20. In addition, the upper wipers 50 are arranged close to the nozzle or the inlet of the suction channel 30 (as shown in FIG. 2), and configured to wipe off the cleaning liquid or stains remaining on the front brushroll 10 and the rear brushroll 20 before suction, or configured to wipe and suction in one area substantially at the same time, thus improving the cleanliness of the front brushroll 10 and the rear brushroll 20 and avoiding the secondary pollution to the cleaning surface caused by the stains or excessive cleaning fluid on the brushroll that is thrown out due to a centrifugal force, thereby improving the cleaning effect.

In an embodiment of the present disclosure, the upper wipers 50 are arranged at a certain angle with respect to the circumferences of the front brushroll 10 and the rear brushroll 20 and are in interference contact with the circumferences of the front brushroll 10 and the rear brushroll 20. The interference contact enables the upper wipers 50 to tightly abut the circumferences of the front brushroll 10 and the rear brushroll 20. This provides better cleaning of the stains or cleaning liquid attached on the circumference of the brushrolls, and further improves the cleaning effect of the front brushroll 10 and the rear brushroll 20.

In an embodiment of the present disclosure, the upper wiper 50 includes a stain sub-wiper, configured to wipe off the cleaning fluid or stains remaining on the circumferences of the brushrolls.

In an embodiment of the present disclosure, as illustrated in FIGS. 2 and 3, two wipers are provided, namely, a first wiper 501 and a second wiper 502. The first wiper 501 is arranged at a certain angle with respect to the circumference of the front brushroll 10 and is in interference contact with the front brushroll 10. Thus, the first wiper 501 is in full contact with the front brushroll 10, thereby enhancing the cleaning effect of the first wiper 501 on the rear brushroll 10. Similarly, the second wiper 502 is arranged at a certain angle with respect to the circumference of the rear brushroll 20 and is in interference contact with the rear brushroll 20. Thus, the second wiper 502 is in full contact with the rear brushroll 20, thereby enhancing the cleaning effect of the second wiper 502 on the rear brushroll 20. A surface of the wiper is at an acute angle relative to a linear velocity direction of the rotation motion of the brushroll, i.e., with respect to a tangential direction of the circumference, which increases resistance of the wiper to the brushroll, and thereby improves the wiping effect of the wiper on the brushrolls.

As illustrated in FIGS. 2 and 3, the first wiper 501 includes a first stain sub-wiper 5011 installed on a first side of a first fluid distributor 180 located above the front brushroll 10. The first stain sub-wiper 5011 is arranged at a certain angle with respect to the circumference of the front brushroll 10 and is in interference contact with the front brushroll 10. The second wiper 502 includes a second stain sub-wiper 5021 installed on a first side of a second fluid distributor 180 located above the rear brushroll 20. The second stain sub-wiper 5021 is arranged at a certain angle with respect to the circumference of the rear brushroll 20 and is in interference contact with the rear brushroll 20. The first side of the first fluid distributor is either of the two sides along a longitudinal direction of the first fluid distributor, and the first side of the second fluid distributor is either of the two sides along a longitudinal direction of the second fluid distributor.

The cleaning fluid flows out of the fluid distributor 180 and falls onto the surface to be cleaned as the brushrolls rotate. After fully mixed with stains on the ground by the friction between the brushrolls and the ground, the cleaning fluid is carried by the rotating brushrolls and suctioned to the inlet of the suction channel 30 due to a suction force by the suction channel. After that, the cleaning fluid is further wiped off by the wiper and suctioned into the suction channel 30 due to wiping by the stain sub-wiper. Finally, the cleaning fluid enters the collection tank 90. Therefore, with the first stain sub-wiper 5011 and the second stain sub-wiper 5021, the cleaning surface is prevented from secondary pollution caused by the stains or dirty water attached on the front brushroll 10 and the rear brushroll 20 that is thrown out due to the centrifugal force.

In some embodiments of the present disclosure, the first stain sub-wiper 5011 and the second stain sub-wiper 5021 are made of a rigid material, thereby helping to provide a relatively great wiping force for wiping off difficult-to-remove stains on the front brushroll 10 or the rear brushroll 20, so as to enhance the wiping effect. The rigid material includes, but is not limited to, plastics and the like.

Further, the wiper further includes a liquid retaining sub-wiper, configured to enable the cleaning liquid to fully contact the brushrolls. In other words, the upper wiper 50 further includes a liquid retaining sub-wiper, configured to enable the cleaning liquid to fully contact the brushrolls.

For example, the first wiper 501 further includes a first liquid retaining sub-wiper 5012, installed on a second side of the first fluid distributor 180 located above the front brushroll 10. The first liquid retaining sub-wiper 5012 is arranged at an angle with respect to the circumference of the front brushroll 10 and is in interference contact with the front brushroll 10. The second wiper 502 includes a second liquid retaining sub-wiper 5022, installed on a second side of the second fluid distributor 180 located above the rear brushroll 20. The second liquid retaining sub-wiper 5022 is arranged at a certain angle with respect to the circumference of the rear brushroll 20 and is in interference contact with the rear brushroll 20. The second side of the first fluid distributor is opposite the first side of the first fluid distributor, and the second side of the second fluid distributor is opposite the first side of the second fluid distributor.

After stains and dirty water attached to the front brushroll 10 are wiped off by the first stain sub-wiper 5011, the clean cleaning liquid flows to the front brushroll 10, and then is wiped by the first liquid retaining sub-wiper 5012. Thus, the front brushroll 10 can more fully absorb the cleaning liquid sprayed thereon, so as to form a self-cleaning cycle of the front brushroll 10 in operation, which can improve not only the cleanliness of the front brushroll 10 but also the cleaning effect of the front brushroll 10 on the surface to be cleaned. Similarly, after stains and dirty water attached to the rear brushroll 20 is wiped off by the second stain sub-wiper 5021, the clean cleaning liquid flows to the rear brushroll 20, and then is wiped by the second liquid retaining sub-wiper 5022. Thus, the rear brushroll 20 can more fully absorb the cleaning liquid sprayed thereon, so as to form a self-cleaning cycle of the rear brushroll 20 in operation, which can improve not only the cleanliness of the rear brushroll 20 but also the cleaning effect of the rear brushroll 20 on the surface to be cleaned.

In some embodiments of the present disclosure, the first liquid retaining sub-wiper 5012 and the second liquid retaining sub-wiper 5022 are made of a soft material, which provides a relative small wiping force to prevent the cleaning liquid on the brushroll from being wiped off. The soft material includes, but is not limited to, rubber, metal shrapnel, etc.

Figure 11:
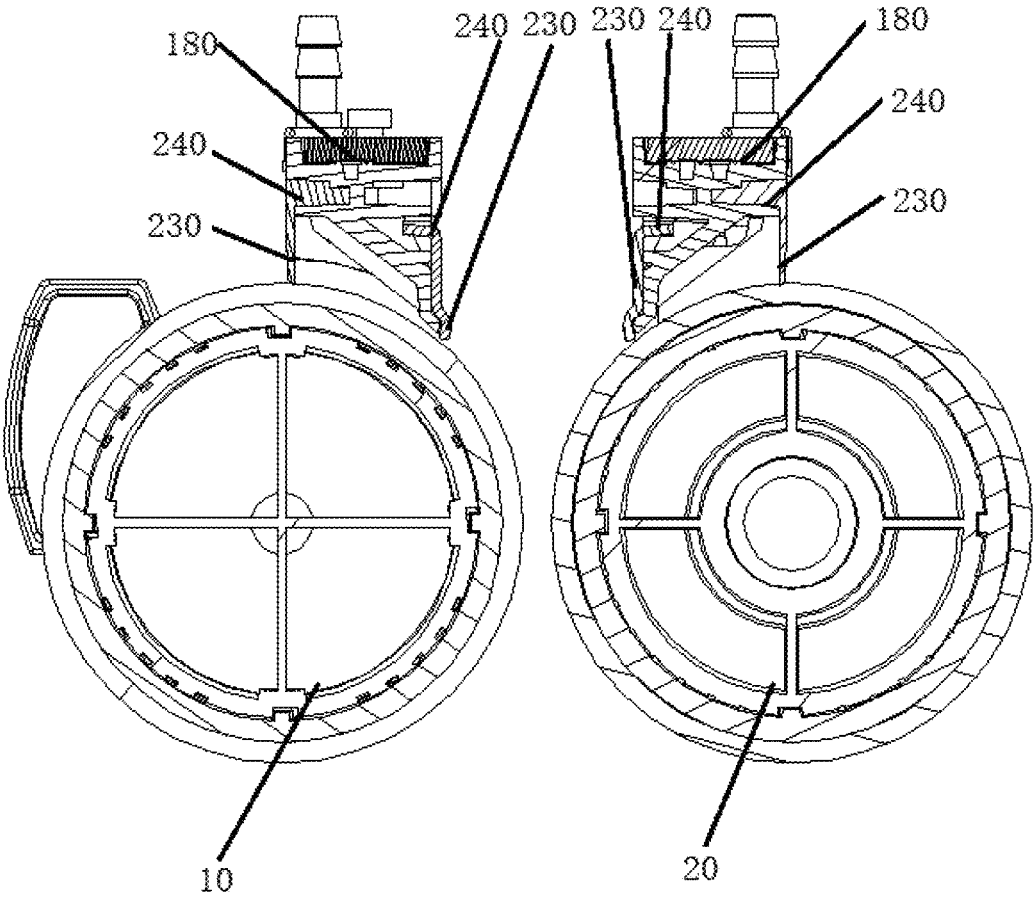
FIG. 11 illustrates a partially enlarged view of FIG. 2.

In an embodiment of the present disclosure, as illustrated in FIG. 11, the first stain sub-wiper 5011, the second stain sub-wiper 5021, the first liquid retaining sub-wiper 5012, and the second liquid retaining sub-wiper 5022 each include a contact portion 230 and a connection portion 240 that are integrally connected. The connection portion 240 and the contact portion 230 are formed as an elastic sheet. Thus, in a case in which the contact portion 230 is in contact with the circumference of the front brushroll 10 or the rear brushroll 20, the contact portion 230 can wipe off the stains or excess cleaning liquid remaining on the circumference of the front brushroll 10 or the rear brushroll 20 relatively smoothly.

The handheld cleaning device according to an embodiment of the present disclosure further includes a housing 70. The housing 70 has an accommodation compartment. Parts of the front brushroll 10 and the rear brushroll 20 are installed in the accommodation compartment of the housing 70, and a remaining part of the front brushroll 10 and a remaining part of the rear brushroll 20 protrude from the housing 70 to be in contact with the surface to be cleaned and is configured to clean the surface to be cleaned. The housing 70 includes an upper cover and a lower housing 70 that are detachably connected, so as to facilitate the user or an operator to inspect and maintain internal components in the housing. The upper cover is configured to close the lower housing and is further connected to the upright portion 150 at the same time. The detachable connection can be achieved by an existing detachable connection such as a connection by a snap or a bolt, which is not limited in the embodiments of the present disclosure.

Another arrangement of the wiper is as illustrated in FIGS. 2 and 3. In a case in which the wiper is arranged on the circumference of the brushroll and is in contact with the surface to be cleaned and is configured to wipe off the cleaning fluid or stains remaining on the surface to be cleaned; the wiper is located below the front brushroll 10 and the rear brushroll 20, i.e., a lower wiper 60. An end of the lower wiper 60 is installed on the housing 70 and is arranged close to the remaining part of the rear brushroll 20 that protrudes from the housing 70. The other end of the lower wiper 60 protrudes from the housing 70. Thus, in a case in which the handheld cleaning device moves across the surface to be cleaned, the lower wiper 60 can contact the surface to be cleaned and wipe off the stains on the surface to be cleaned at the same time, thus further cleaning the surface to be cleaned.

Figure 12:
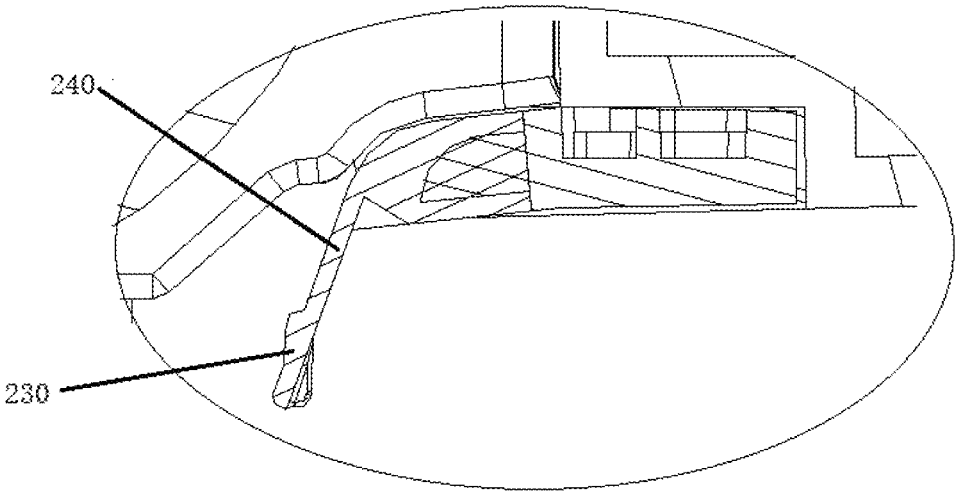
FIG. 12 illustrates a partially enlarged view of FIG. 2.

As illustrated in FIGS. 2, 3 and 12, the lower wiper 60 further includes a contact portion 230 and a connection portion 240 that are integrally connected. The contact portion 230 is formed as an elastic sheet. Thus, in a case in which the contact portion 230 is in contact with the surface to be cleaned, the contact portion 230 can wipe off the stains or excess cleaning liquid remaining on the surface to be cleaned relatively smoothly.

The handheld cleaning device in an embodiment further includes a brushroll drive gearbox 40, including a first drive gearbox and a second drive gearbox. The first drive gearbox is in transmission connection with the front brushroll 10 and is configured to drive the front brushroll 10 to rotate. The second drive gearbox is in transmission connection with the rear brushroll 20 and is configured to drive the rear brushroll 20 to rotate.

The first drive gearbox is driven by a second motor to drive the front brushroll 10 to rotate. The second drive gearbox is in transmission connection with the rear brushroll 20 through a belt 110. A first motor drives the rear gearbox brushroll 20, which in turn drives the belt 110 to rotate. Then, the belt 110 drives the rear brushroll 20 to rotate. In an embodiment of the present disclosure, the transmission is carried out by the brushroll gearbox 40, so as to drive the front brushroll 10 and the rear brushroll 20 to rotate. This ensures the transmission stability and reliability and provides a relatively high transmission power.

At least two gears engaged with each other are arranged in the first drive gearbox, one of which is connected to the second motor to act as a main gear, and the other of which is in transmission connection with the front brushroll to act as a driven gear. In this case, the second motor drives the main gear to rotate, which in turn drives the driven gear to rotate together, thus driving the front brushroll 10 to rotate.

At least two gears engaged with each other are arranged in the second drive gearbox, one of which acts as a main gear and is connected to the first motor, and the other of which acts as a driven gear that is in transmission connection with the rear brushroll. In this case, the first motor drives the main gear to rotate, which in turn drives the driven gear to rotate together, thus driving the rear brushroll 20 to rotate.

In an embodiment of the present disclosure, an external case of the brushroll drive gearbox 40 is made of a sound-absorbing material, so as to reduce noise generated during the operation of the brushroll drive gearbox 40.

Figure 4:
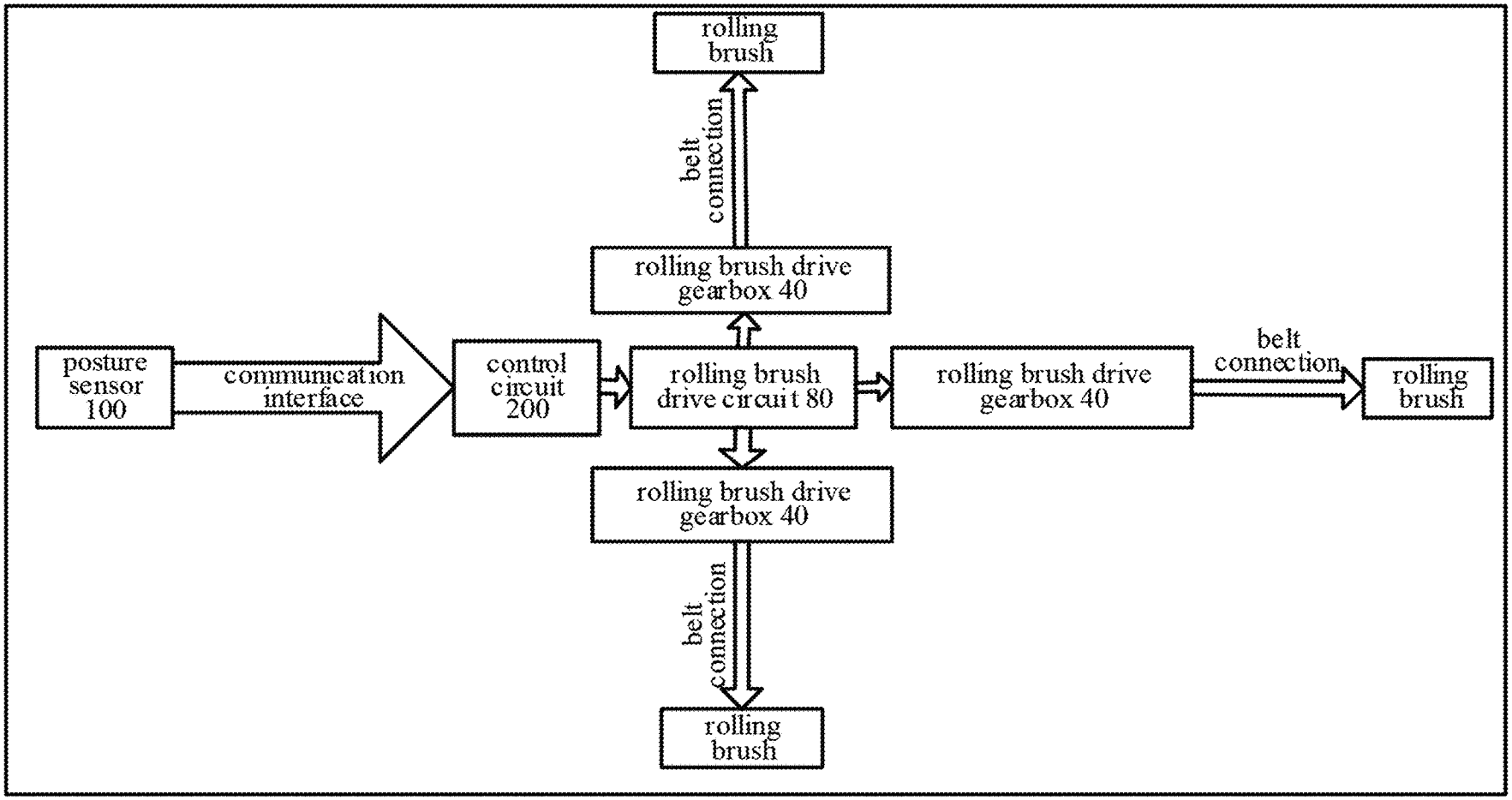
FIG. 4 illustrates a schematic circuit diagram of a handheld cleaning device according to an embodiment of the present disclosure.

FIG. 4 illustrates a schematic circuit diagram of the handheld cleaning device according to an embodiment of the present disclosure. Referring to FIG. 4, in an embodiment of the present disclosure, the handheld cleaning device further includes a posture sensor 100, a control circuit 200 and a brushroll drive circuit 80.

The posture sensor 100 is configured to sense movement direction information of the handheld cleaning device and transmit the movement direction information to the control circuit 200. In an embodiment of the present disclosure, the posture sensor 100 is a six-axis sensor, which obtains acceleration data of the brushroll according to the embodiments of the present disclosure in real time. At the same time, since the acceleration data of the handheld cleaning device according to the embodiments of the present disclosure are different when moving forward and backward, it can be determined whether the movement direction of the handheld cleaning device is forward or backward according to different acceleration data obtained by the six-axis sensor in real time.

The control circuit 200 may be implemented by an application-specific integrated circuit, a digital signal processor, a digital signal processing device, a programmable logic device, a field programmable gate array, a micro control unit, a microprocessor or other electronic elements. The control circuit 200 is connected to the six-axis sensor via a communication interface, so as to obtain the acceleration data detected by the six-axis sensor and determine the movement direction information of the handheld cleaning device according to the acceleration data. At the same time, the control circuit 200 is further electrically connected to a brushroll drive circuit 80 and controls the brushroll drive circuit 80 based on the obtained movement direction information of the handheld cleaning device, so that the brushroll drive circuit 80 drives the brushroll drive gearbox 40 to rotate.

The brushroll drive gearbox 40 includes a first drive gearbox configured to drive the front brushroll 10 and a second drive gearbox configured to drive the rear brushroll 20. In a case in which the movement direction information of the handheld cleaning device indicates forward movement, the control circuit 200 controls a rotation speed of the first drive gearbox to be greater than that of the second drive gearbox, so that a rotation speed of the front brushroll 10 is greater than that of the rear brushroll 20. In a case in which the movement direction information of the handheld cleaning device indicates a backward movement, the control circuit 200 controls a rotation speed of the second drive gearbox to be greater than that of the first drive gearbox, so that a rotation speed of the rear brushroll 20 is greater than that of the front brushroll 10. Thus, the handheld cleaning device according to an embodiment of the present disclosure is provided with a front assist force when moving forward and is provided with a rear assist force when moving backward, thereby reducing a pushing and pulling force by the user to move the handheld cleaning device.

The handheld cleaning device further includes a liquid level sensor, arranged in at least one of the cleaning liquid tank 220, the collection tank 90 and the liquid supply pipe 130 of the handheld cleaning device. The liquid level sensor is connected to the control circuit and is configured to sense liquid level information of the handheld cleaning device and transmit the liquid level information to the control circuit 200.

In a case in which the liquid level sensor is arranged in the collection tank 90 of the stain collector, the liquid level sensor is configured to detect a fluid level in the collection tank 90. The liquid level sensor can detect a value of the fluid level in the collection tank 90 in real time and send the value of the fluid level to the control circuit 200, and the control circuit 200 compares the value of the fluid level with a first liquid level threshold. If the value of the fluid level is greater than or equal to the first liquid level threshold, the control circuit 200 activates a prompt device or an alarm device on the handheld cleaning device to prompt or give an alarm, so as to remind the user to stop using the handheld cleaning device and avoid the fluid overflowing from the collection tank 90.

In an embodiment of the present disclosure, the liquid level sensor is a non-contact sensor or a contact sensor. The non-contact sensor is a capacitive sensor.

The contact sensor includes a positive electrode and a negative electrode extending into the collection tank 90. The control circuit 200 is electrically connected respectively to the positive electrode and the negative electrode. In a case in which the positive electrode and the negative electrode are in contact with the fluid, the electrodes are conducted through the fluid. The control circuit 200 determines that a value of the fluid level in the collection tank 90 is greater than or equal to the first level threshold, so that the control circuit 200 controls the handheld cleaning device to stop working and controls the alarm device to give an alarm.

As the fluid moves away from or approaches a capacitive sensor, a capacitance of the capacitive sensor changes. That is to say, in a case in which there is no fluid approaching, the capacitive sensor has a small parasitic capacitance, and in a case in which the fluid approaches the capacitive sensor, the parasitic capacitance changes. Thus, it can be detected whether there is fluid in a fluid output pipe based on the change of the parasitic capacitance.

The control circuit 200 obtains a difference between a sensed real-time capacitance and a sensed environment capacitance, wherein the sensed environment capacitance is a capacitance that is sensed in a case in which there is no fluid in the collection tank 90. Then, the control circuit 200 compares the difference with a preset threshold. If the difference is greater than or equal to the preset difference, it is determined that a value of the fluid level in the collection tank 90 is greater than or equal to the first liquid level threshold, so that the control circuit 200 controls the handheld cleaning device to stop working and controls the alarm device to give an alarm.

The fluid in the fluid distributor 180 decreases as the handheld cleaning device operates. Therefore, in an embodiment of the present disclosure, the liquid level sensor is arranged in the cleaning liquid tank 220 and is configured to detect a fluid level in the cleaning liquid tank 220.

The liquid level sensor may detect a value of the fluid level in the cleaning liquid tank 220 in real time, and the control circuit 200 compares the value of the fluid level detected by the liquid level sensor with a second liquid level threshold. If the value of the fluid level is less than the second liquid level threshold, the control circuit 200 activates the prompt device or the alarm device of the handheld cleaning device to prompt or give an alarm, thereby reminding the user to replenish the cleaning liquid tank 220 with the cleaning liquid and avoiding affecting the cleaning effect.

Alternatively, the liquid level sensor is arranged in the liquid supply pipe 130 and is configured to detect whether there is fluid in the liquid supply pipe 130.

The liquid level sensor may detect a value of the fluid level in the liquid supply pipe 130 in real time, and the control circuit 200 compares the value of the fluid level detected by the liquid level sensor with a third liquid level threshold. If the value of the fluid level is less than the third liquid level threshold, the control circuit activates the prompt device or the alarm device of the handheld cleaning device to prompt or give an alarm, thereby reminding the user to replenish the cleaning liquid tank 220 with the cleaning liquid and avoiding affecting the cleaning effect.

The prompt device includes but is not limited to a prompt lamp, and the alarm device includes but is not limited to a buzzer or a voice-broadcasting device. The second liquid level threshold and the third liquid level threshold can be set manually, which is not limited in the embodiments of the present disclosure.

Similarly, in an embodiment of the present disclosure, the liquid level sensor is a non-contact sensor or a contact sensor. The non-contact sensor is a capacitive sensor.

In a case in which the liquid level sensor is a contact sensor, the contact sensor includes a positive electrode and a negative electrode extending into the liquid supply pipe 130 or the cleaning liquid tank 220. The control circuit 200 is electrically connected to the positive electrode and the negative electrode, respectively. In a case in which the positive electrode and the negative electrode are in contact with the fluid, the electrodes are conducted through the fluid. The control circuit 200 determines that there is sufficient fluid in the cleaning liquid tank 220 for cleaning operation, so that the control device controls the handheld cleaning device to continue working. In a case in which the electrodes are not in contact with the fluid, the positive electrode and the negative electrode are isolated. The control circuit 200 determines that there is not sufficient fluid in the cleaning liquid tank 220 for the cleaning operation, so that the control device controls the handheld cleaning device to stop working and controls the alarm device to give an alarm.

In a case in which the liquid level sensor is a capacitive sensor, the control circuit 200 obtains a difference between a sensed real-time capacitance value and a sensed environment capacitance value, wherein the sensed environment capacitance is a capacitance value that is sensed in a case in which there is no fluid in the liquid supply pipe 130. Then, the control circuit 200 compares the difference with a preset threshold. If the difference is greater than or equal to the preset threshold, it is determined that there is cleaning fluid in the liquid supply pipe 130 or the cleaning liquid tank 220. Therefore, it is determined that there is sufficient fluid in the cleaning liquid tank for cleaning operation. Then, the control circuit 200 controls the handheld cleaning device to continue working according to the detection result. If the difference is less than the preset threshold, it is determined that there is not sufficient fluid in the liquid supply pipe 130 or the cleaning liquid tank 220. Therefore, it is determined that there is not sufficient fluid in the cleaning liquid tank 220 for cleaning operation. Then, the control circuit 200 controls the handheld cleaning device to stop working and controls the alarm device to give an alarm based on the detection result.

As illustrated in FIGS. 1 and 6, at least one embodiment of the present disclosure further provides a handheld cleaning device, including a surface-moving portion 160 and an upright portion 150. The surface-moving portion 160 is in contact with the surface to be cleaned and is connected to the upright portion 150. The upright portion 150 is configured to move the surface-moving portion. The surface-moving portion 160 further includes at least two brushrolls and a fluid distributor 180 which is configured to deliver the cleaning liquid to each of the at least two brushrolls.

The fluid distributor 180 is a device that controls cleaning liquid. The cleaning liquid may be any one of clean water, a cleaning agent or a mixture thereof. The fluid distributor 180 sprays the liquid onto the surface to be cleaned. Then, cleaning can be done by the brushrolls. The fluid distributor 180 can increase the spraying area of the cleaning liquid, thereby improving the cleaning effect and the cleaning efficiency.

It should be understood that descriptions of other parts of the handheld cleaning device, such as the power battery, the brushroll and the wiper, can be referred to the foregoing description and will not be repeated herein. It should be noted that if there are two or more brushrolls, it is not limited to whether or not all the brushrolls are non-coaxial, which means that all the brushrolls may be non-coaxial, or only some of the brushrolls may be non-coaxial.

The fluid distributor 180 includes a fluid inlet 1802, a fluid distribution channel 1803, and at least two fluid outlets 1801. The fluid inlet 1802 is connected to a liquid supply pipe 130, and the fluid distribution channel 1803 is configured to distribute inflowing cleaning fluid to the at least two fluid outlets 1801.

The surface-moving portion 160 further includes at least one wiper. The wiper is disposed close to or in contact with a circumference of the brushroll, and is configured to wipe off the cleaning fluid or stains remaining on the brushroll.

In an embodiment of the present disclosure, the wiper is disposed above the brushroll. In an embodiment of the present disclosure, the wiper includes a stain sub-wiper, configured to wipe off the cleaning fluid or stains remaining on the circumference of the brushroll.

In an embodiment of the present disclosure, the wiper further includes a liquid retaining sub-wiper, configured to enable the cleaning fluid to fully contact with the brushroll.

In an embodiment of the present disclosure, the wiper is arranged at a certain angle with respect to the circumference of the brushroll and is in interference contact with the circumference of the brushroll.

The upright portion 150 further includes a stain collector. The stain collector includes a collection tank 90 and at least one suction channel 30. A first end of the suction channel 30 is connected to the collection tank 90. A second end of the suction channel 30 is arranged on a side of the brushroll away from the surface to be cleaned, or arranged adjacent to the surface to be cleaned, so as to collect stains into the collection tank 90 via the suction channel 30.

In an embodiment of the present disclosure, the surface-moving portion 160 further includes a brushroll drive gearbox. The brushroll drive gearbox are in transmission connection with the at least two brushrolls respectively and are configured to drive the at least two brushrolls to rotate respectively.

In an embodiment of the present disclosure, the handheld cleaning device further includes a control circuit 200, configured to control the handheld cleaning device; and a posture sensor 100, connected to the control circuit 200 and configured to sense movement direction information of the handheld cleaning device and transmit the movement direction information to the control circuit 200.

In an embodiment of the present disclosure, the posture sensor 100 includes a six-axis sensor.

In an embodiment of the present disclosure, the brushrolls include a front brushroll 10 and a rear brushroll 20 arranged in parallel on a horizontal plane. The front brushroll 10 and the rear brushroll 20 rotate circumferentially in different directions, so as to collect garbage on the surface to be cleaned into a gap between the front brushroll 10 and the rear brushroll 20.

In an embodiment of the present disclosure, in a case in which the movement direction information indicates a forward movement, the control circuit 200 controls a rotation speed of the front brushroll 10 to be greater than a rotation speed of the rear brushroll 20. In a case in which the movement direction information indicates a backward movement, the control circuit 200 controls the rotation speed of the rear brushroll 20 to be greater than the rotation speed of the front brushroll 10.

In an embodiment of the present disclosure, one of the front brushroll and the rear brushroll includes a first brushroll part 201 and a second brushroll part 202 that are arranged coaxially. Both the first brushroll part 201 and the second brushroll part 202 are connected to a drive mechanism. The drive mechanism includes a first motor, a belt and a driven shaft. The driven shaft is arranged in a position where the first brushroll part 201 and the second brushroll part 202 are close to each other. The belt is connected to a first motor and connected to the driven shaft. A rotating rod 190 is arranged coaxially with the driven shaft and is extended in respective axis directions of the driven shaft, and the first brushroll part 201 and the second brushroll part 202 are sleeved on the rotating rod 190, respectively. The first motor drives the belt to rotate, which in turn drives the first brushroll part 201 and the second brushroll part 202 to rotate.

In an embodiment of the present disclosure, the handheld cleaning device further includes a liquid level sensor, installed on at least one of a cleaning liquid tank 220, a collection tank 90 and a liquid supply pipe 130 of the handheld cleaning device. The liquid level sensor is connected to the control circuit and is configured to sense liquid level information of the handheld cleaning device and transmit the liquid level information to the control circuit.

At least one embodiment of the present disclosure further provides a handheld cleaning device. As illustrated in FIGS. 2 and 3, the handheld cleaning device includes a surface-moving portion 160 and an upright portion 150 (as shown in FIG. 1). The surface-moving portion 160 is in contact with the surface to be cleaned and is connected to the upright portion 150. The upright portion 150 is configured to move the surface-moving portion. The handheld cleaning device further includes a power battery, configured to supply power to the handheld cleaning device. The surface-moving portion 160 further includes at least two brushrolls and at least two wipers which correspond to each other, respectively. As to a brushroll and a wiper which correspond to each other, the wiper is disposed close to or in contact with a circumference of the brushroll and is configured to wipe off the cleaning liquid or stains remaining on the brushroll.

The wiper can wipe off the cleaning fluid or stains remaining on the circumferences of the brushroll, as well as the cleaning fluid or stains remaining on the surface to be cleaned. This improves cleanliness of the brushrolls and avoids secondary pollution to the cleaning surface caused by the stains or excessive cleaning fluid on the brushroll being thrown out due to a centrifugal force. The wiper further assists the brushroll in cleaning the surface to be cleaned, so as to improve the cleaning effect.

It should be understood that with respect to other parts of the handheld cleaning device according to embodiments of the present disclosure, such as the power battery, a fluid distributor 180, and a liquid supply pipe, relevant descriptions in the previous embodiments can be referred to, which will not be elaborated herein.

In an embodiment of the present disclosure, the wiper is located above the brushroll.

In an embodiment of the present disclosure, the wiper includes a stain sub-wiper, configured to wipe off the cleaning fluid or stains remaining on the circumference of the brushroll.

In an embodiment of the present disclosure, the wiper further includes a liquid retaining sub-wiper, configured to enable the cleaning liquid to fully contact the brushroll.

In an embodiment of the present disclosure, the wiper is arranged at a certain angle with respect to the circumference of the brushroll and is in interference contact with the circumference of the brushroll. The upright portion 150 further includes a stain collector. The stain collector includes a collection tank 90 and at least one suction channel 30. A first end of the suction channel 30 is connected to the collection tank 90. A second end of the suction channel 30 is arranged on a side of the brushroll away from the surface to be cleaned or is arranged adjacent to the surface to be cleaned, so as to collect stains into the collection tank 90 via the suction channel 30.

In an embodiment of the present disclosure, the surface-moving portion 160 further includes a brushroll drive gearboxes 40 which are in transmission connection with the at least two brushrolls respectively and configured to drive the at least two brushrolls to rotate respectively.

In an embodiment of the present disclosure, the handheld cleaning device further includes a control circuit 200, configured to control the handheld cleaning device; and a posture sensor 100 in connection with the control circuit 200, configured to sense movement direction information of the handheld cleaning device and transmit the movement direction information to the control circuit 200.

In an embodiment of the present disclosure, the posture sensor 100 includes a six-axis sensor.

In an embodiment of the present disclosure, the brushroll include a front brushroll 10 and a rear brushroll 20 arranged in parallel on a horizontal plane. The front brushroll 10 and the rear brushroll 20 rotate circumferentially in different directions, so as to collect garbage on the surface to be cleaned into a gap between the front brushroll 10 and the rear brushroll 20.

In a case in which the movement direction information indicates forward movement, the control circuit 200 controls a rotation speed of the front brushroll 10 to be greater than a rotation speed of the rear brushroll 20. In a case in which the movement direction information indicates a backward movement, the control circuit 200 controls the rotation speed of the rear brushroll 20 to be greater than the rotation speed of the front brushroll 10.

One of the front and rear brushrolls includes a first brushroll part 201 and a second brushroll part 202 that are arranged coaxially. Both the first brushroll part 201 and the second brushroll part 202 are connected to a drive mechanism. The drive mechanism includes a first motor and a belt, and is arranged at a position where the first brushroll part 201 and the second brushroll part 202 are close to each other. The belt is connected to a first motor and connected to a driven shaft. A rotating rod 190 is arranged coaxially with the driven shaft and is extended in respective axis directions of the driven shaft, and the first brushroll part 201 and the second brushroll part 202 are sleeved on the rotating rod 190, respectively. The first motor drives the belt to rotate, which in turn drives the first brushroll part 201 and the second brushroll part 202 to rotate.

In an embodiment of the present disclosure, the handheld cleaning device further includes a liquid level sensor, installed on at least one of a cleaning liquid tank 220, a collection tank 90 and a liquid supply pipe 130 of the handheld cleaning device. The liquid level sensor is connected to the control circuit and is configured to sense liquid level information of the handheld cleaning device and transmit the liquid level information to the control circuit.

At least one embodiment of the present disclosure further provides a handheld cleaning device, including a surface-moving portion 160 and an upright portion 150. The surface-moving portion 160 is configured to be in contact with the surface to be cleaned and is connected to the upright portion 150. The upright part 150 is configured to move the surface-moving portion 160. The handheld cleaning device further includes a power battery, configured to supply power to the handheld cleaning device. The surface-moving portion 160 further includes at least two brushrolls which are disposed non-coaxially. One of the brushrolls includes a first brushroll part 201 and a second brushroll part 202 that are arranged coaxially. The first brushroll part 201 and the second brushroll part 202 are in transmission connection with a driving mechanism.

In an embodiment of the present disclosure, the drive mechanism includes a belt 110 a first motor, and a driven shaft. The driven shaft is arranged between the first brushroll part 201 and the second brushroll part 202. The belt 110 is connected to a first motor and connected to the driven shaft. A rotating rod 190 is arranged coaxially with the driven shaft and is extended in respective axis directions of the driven shaft, and the first brushroll part 201 and the second brushroll part 202 are sleeved on the rotating rod 190, respectively. The first motor drives the belt 110 to rotate, which in turn drives the first brushroll part 201 and the second brushroll part 202 to rotate.

In an embodiment of the present disclosure, a flow guide plate 170 is arranged at a gap between the first brushroll part 201 and the second brushroll part 202. A lower portion of the flow guide plate 170 is inclined gradually in a direction away from the first brushroll part 201 and the second brushroll part 202.

In an embodiment of the present disclosure, the surface-moving portion further includes a housing 70. An escape opening 701 is provided in a side wall of the housing 70 at a position corresponding to an end of at least one brushroll. The end of the at least one brushroll extends to the escape opening 701 of the side wall and is flush with the side wall 140.

In an embodiment of the present disclosure, the surface-moving portion further includes at least one wiper. The wiper is configured to be in contact with a circumference of the brushroll, and to wipe off the cleaning liquid or stains remaining on the circumference of the brushroll.

In an embodiment of the present disclosure, the wiper is located above the brushroll.

In an embodiment of the present disclosure, the wiper includes a stain sub-wiper, configured to wipe off the cleaning liquid or stains remaining on the circumference of the brushroll.

In an embodiment of the present disclosure, the wiper further includes a liquid retaining sub-wiper, configured to enable the cleaning liquid to fully contact the brushroll.

In an embodiment of the present disclosure, the wiper is arranged at a certain angle with respect to the circumference of the brushroll and is in interference contact with the circumference of the brushroll.

In an embodiment of the present disclosure, the surface-moving portion further includes a fluid distributor 180. The fluid distributor 180 includes a fluid inlet 1802, a fluid distribution channel 1803 and at least two fluid outlets 1801. The fluid inlet 1802 is connected to a liquid supply pipe 130. The fluid distribution channel 1803 distributes inflowing cleaning fluid to the at least two fluid outlets 1801.

In an embodiment of the present disclosure, the upright portion further includes a stain collector. The stain collector includes a collection tank 90 and at least one suction channel 30. A first end of the suction channel 30 is connected to the collection tank 90. A second end of the suction channel 30 is arranged on a side of the brushroll away from the surface to be cleaned or arranged at a position close to the surface to be cleaned, so as to collect stains into the collection tank 90 via the suction channel 30.

In an embodiment of the present disclosure, the surface-moving portion further includes a brushroll drive gearbox 40, being in transmission connection with the at least two brushrolls and configured to drive the brushrolls to rotate, respectively.

In an embodiment of the present disclosure, the handheld cleaning device further includes a control circuit 200, configured to control the handheld cleaning device; and a posture sensor 100 in connection with the control circuit, configured to sense movement direction information of the handheld cleaning device and transmit the movement direction information to the control circuit.

In an embodiment of the present disclosure, the posture sensor includes a six-axis sensor.

In an embodiment of the present disclosure, the at least two brushrolls include a front brushroll 10 and a rear brushroll 20 arranged in parallel on a horizontal plane. The front brushroll 10 and the rear brushroll 20 rotate circumferentially in different directions, so as to collect garbage on the surface to be cleaned into a gap between the front brushroll 10 and the rear brushroll 20.

In an embodiment of the present disclosure, in a case in which the movement direction information indicates a forward movement, the control circuit 200 controls a rotation speed of the front brushroll 10 to be greater than a rotation speed of the rear brushroll 20. In a case in which the movement direction information indicates a backward movement, the control circuit 200 controls the rotation speed of the rear brushroll 20 to be greater than the rotation speed of the front brushroll 10.

In an embodiment of the present disclosure, both the rotation speed of the front brushroll and the rotation speed of the rear brushroll are less than 3000 r/min.

In an embodiment of the present disclosure, the handheld cleaning device further includes a liquid level sensor, installed on at least one of a cleaning liquid tank 220, a collection tank 90 and a liquid supply pipe 130 of the handheld cleaning device. The liquid level sensor is connected to the control circuit and is configured to sense liquid level information of the handheld cleaning device and transmit the liquid level information to the control circuit.

At least one embodiment of the present disclosure further provides a handheld cleaning device, including a surface-moving portion 160 and an upright portion 150. The surface-moving portion 160 is configured to be in contact with the surface to be cleaned and is connected to the upright portion 150. The upright portion 150 is configured to move the surface-moving portion 160. The handheld cleaning device further includes a power battery, configured to supply power to the handheld cleaning device. The surface-moving portion 160 further includes a housing 70 and at least one brushroll. An escape opening 701 is provided in a side wall of the housing 70 at a position corresponding to an end of the at least one brushroll. The end of the at least one brushroll extends to the escape opening of the side wall and is flush with the side wall 140.

In an embodiment of the present disclosure, one of the brushrolls includes a first brushroll part 201 and a second brushroll part 202 that are arranged coaxially. The first brushroll part 201 and the second brushroll part 202 are in transmission connection with a drive mechanism.

In an embodiment of the present disclosure, the drive mechanism includes a first motor, a belt 110, and a driven shaft. The driven shaft is arranged between the first brushroll part 201 and the second brushroll part 202. The belt 110 is connected to the first motor and connected to the driven shaft. A rotating rod 190 is arranged coaxially with the driven shaft and is extended in respective axis directions of the driven shaft, and the first brushroll part 201 and the second brushroll part 202 are sleeved on the rotating rod 190, respectively. The first motor drives the belt 110 to rotate, which in turn drives the first brushroll part 201 and the second brushroll part 202 to rotate.

In an embodiment of the present disclosure, a flow guide plate 170 is arranged at a gap between the first brushroll part 201 and the second brushroll part 202. A lower portion of the flow guide plate 170 is inclined gradually in a direction away from the first brushroll part 201 and the second brushroll part 202.

In an embodiment of the present disclosure, the surface-moving portion further includes at least one wiper each of which corresponds to a respective one of the at least one brushroll. As to a brushroll and a wiper which correspond to each other, the wiper is configured to be in contact with a circumference of the brushroll and is configured to wipe off cleaning liquid or stains remaining on the circumference of the brushroll.

In an embodiment of the present disclosure, the wiper is located above the brushroll. The wiper includes a stain sub-wiper, configured to wipe off cleaning liquid or stains remaining on the circumference of the brushroll.

In an embodiment of the present disclosure, the wiper further includes a liquid retaining sub-wiper, configured to enable the cleaning liquid to fully contact the brushroll.

In an embodiment of the present disclosure, the wiper is arranged at a certain angle with respect to the circumference of the brushroll and is in interference contact with the circumference of the brushroll.

In an embodiment of the present disclosure, the surface-moving portion further includes a fluid distributor 180. The fluid distributor 180 includes a fluid inlet 1802, a fluid distribution channel 1803 and at least two fluid outlets 1801.

The fluid inlet 1802 is connected to a liquid supply pipe 130. The fluid distribution channel 1803 distributes inflowing cleaning fluid to the at least two fluid outlets 1801.

In an embodiment of the present disclosure, the upright portion further includes a stain collector. The stain collector includes a collection tank 90 and at least one suction channel 30. A first end of the suction channel 30 is connected to the collection tank 90. A second end of the suction channel 30 is arranged on a side of the brushroll away from the surface to be cleaned or arranged at a position close to the surface to be cleaned, so as to collect stains into the collection tank 90 via the suction channel 30.

In an embodiment of the present disclosure, the surface-moving portion further includes a drive gearbox 40, being in transmission connection with the at least two brushrolls, respectively, and configured to drive the at least one brushroll to rotate, respectively; a control circuit 200, configured to control the handheld cleaning device; and a posture sensor 100 in connection with the control circuit 200, configured to sense movement direction information of the handheld cleaning device and transmit the movement direction information to the control circuit.

In an embodiment of the present disclosure, the posture sensor includes a six-axis sensor.

In an embodiment of the present disclosure, the at least one brushroll include a front brushroll 10 and a rear brushroll 20 arranged in parallel on a horizontal plane. The front brushroll 10 and the rear brushroll 20 rotate circumferentially in different directions, so as to collect garbage on the surface to be cleaned into a gap between the front brushroll 10 and the rear brushroll 20.

In a case in which the movement direction information indicates a forward movement, the control circuit 200 controls a rotation speed of the front brushroll 10 to be greater than a rotation speed of the rear brushroll 20. In a case in which the movement direction information indicates a backward movement, the control circuit 200 controls the rotation speed of the rear brushroll 20 to be greater than the rotation speed of the front brushroll 10.

In an embodiment of the present disclosure, both the rotation speed of the front brushroll and the rotation speed of the rear brushroll are less than 3000 r/min.

In an embodiment of the present disclosure, the handheld cleaning device further includes a liquid level sensor, installed on at least one of a cleaning liquid tank 220, a collection tank 90 and a liquid supply pipe 130 of the handheld cleaning device. The liquid level sensor is connected to the control circuit and is configured to sense liquid level information of the handheld cleaning device and transmit the liquid level information to the control circuit.

It should be understood that the above-mentioned specific embodiments of the present disclosure are only used to exemplify or explain the principle of the present disclosure, and do not constitute any limitation to the present disclosure. Therefore, any modification, equivalent replacement, improvement, etc., made without departing from the spirit and scope of the present disclosure should be included in the protection scope of the present disclosure. In addition, the appended claims of the present disclosure are intended to cover all changes and modifications that fall within the scope of the appended claims, or equivalent forms of such scope.

All the embodiments of the present disclosure can be implemented individually or in combination with other embodiments, which are all considered to be the scope of protection claimed by the present disclosure.

What is claimed is:

1. A handheld cleaning device, comprising:

a surface-moving portion;

an upright portion; and a power battery, configured to supply power to the handheld cleaning device, wherein the surface-moving portion is configured to be in contact with a surface to be cleaned and rotatably connected with the upright portion, the upright portion is configured to move the surface-moving portion, and the surface-moving portion further comprises:

at least two brushrolls, configured to clean stains on the surface to be cleaned, wherein a rotation speed of each of the at least two brushrolls is less than 3000 r/min;

a fluid distributor, configured to distribute cleaning liquid to a surface of the at least two brushrolls; and a wiper unit corresponding to each of the at least two brushrolls, each wiper unit comprising a first wiper and a second wiper, wherein a hardness of the first wiper is greater than a hardness of the second wiper, wherein as the at least two brushrolls rotate from a contact position with the surface to be cleaned, stains and dirty water attached to each of the at least two brushrolls are first wiped off by the respective first wiper, and clean cleaning liquid flowing to the at least two brushrolls is then wiped by the respective second wiper, and wherein the fluid distributor distributes cleaning liquid to each of the at least two brushrolls between the respective first and second wipers.

2. The handheld cleaning device according to claim 1, wherein each of the respective first and second wipers is located above the respective brushroll.

3. The handheld cleaning device according to claim 1, wherein each of the respective first and second wipers are disposed at an angle with respect to the circumference of the brushroll at the location of the respective wipers and are in interference contact with the circumference of the brushroll.

4. The handheld cleaning device according to claim 1, wherein the fluid distributor comprises a fluid inlet, a fluid distribution channel, and at least two fluid outlets;

wherein the fluid inlet is connected with a liquid supply pipe, and the fluid distribution channel is configured to distribute inflowing fluid to the at least two fluid outlets.

5. The handheld cleaning device according to claim 1, wherein the upright portion further comprises a stain collector;

the stain collector further comprises a collection tank and at least one suction channel; and each of the at least one suction channel comprises a first end connected with the collection tank, and a second end arranged on a side of the brushrolls away from the surface to be cleaned, such that the stains are collected into the collection tank via the suction channel.

6. The handheld cleaning device according to claim 1, wherein the surface-moving portion further comprises a brushroll drive gearbox, configured to be in transmission connection with the at least two brushrolls, respectively, so as to drive the at least two brushrolls respectively to rotate.

7. The handheld cleaning device according to claim 1, wherein the handheld cleaning device further comprises:

a control circuit, configured to control the handheld cleaning device; and a posture sensor, connected to the control circuit and configured to sense movement direction information of the handheld cleaning device and to transmit the movement direction information to the control circuit.

8. The handheld cleaning device according to claim 7, wherein the posture sensor comprises a six-axis sensor.

9. The handheld cleaning device according to claim 1, wherein the at least two brushrolls comprise a front brushroll and a rear brushroll, the front brushroll and the rear brushroll are arranged in parallel on a horizontal plane, and the front brushroll and the rear brushroll are configured to rotate circumferentially in different directions, to take garbage on the surface to be cleaned into a gap between the front brushroll and the rear brushroll.

10. The handheld cleaning device according to claim 7, wherein the control circuit is configured to:

control a rotation speed of the front brushroll to be greater than a rotation speed of the rear brushroll, in a case in which the movement direction information indicates a forward movement; and control the rotation speed of the rear brushroll to be greater than the rotation speed of the front brushroll, in a case in which the movement direction information indicates a backward movement.

11. The handheld cleaning device according to claim 1, wherein one of the at least two brushrolls comprises a first brushroll part and a second brushroll part that are arranged coaxially, both the first brushroll part and the second brushroll part are connected to a drive mechanism;

the drive mechanism comprises a first motor, a belt and a driven shaft, the belt is connected with the first motor and with the driven shaft, respectively, the driven shaft is provided at a position where the first brushroll part and the second brushroll part are close to each other;

the driven shaft further comprises a rotating rod, which is extended from the driven shaft in respective axis directions of the driven shaft, and the first brushroll part and the second brushroll part are sleeved on the rotating rod respectively; and the first motor drives the belt to rotate, which in turn drives the first brushroll part and the second brushroll part to rotate.

12. The handheld cleaning device according to claim 1, wherein the at least two brushrolls comprise a first brushroll and a second brushroll arranged adjacently.

13. The handheld cleaning device according to claim 12, wherein the stains on the surface to be cleaned are collected from the at least two brushrolls by being suctioned between the first brushroll and the second brushroll.

14. The handheld cleaning device according to claim 7, wherein the handheld cleaning device further comprises a liquid level sensor, installed on at least one of a cleaning liquid tank, a collection tank and a liquid supply pipe of the handheld cleaning device, the liquid level sensor is connected with the control circuit, and is configured to sense liquid level information of the handheld cleaning device and to transmit the liquid level information to the control circuit.

15. The handheld cleaning device according to claim 1, wherein the fluid distributor is located above the at least two brushrolls.

16. A handheld cleaning device, comprising:

a surface-moving portion;

an upright portion; and a power battery, configured to supply power to the handheld cleaning device, wherein the surface-moving portion is configured to be in contact with a surface to be cleaned and rotatably connected with the upright portion, the upright portion is configured to move the surface-moving portion, and the surface-moving portion further comprises:

at least two brushrolls, configured to clean stains on the surface to be cleaned, wherein a rotation speed of each of the at least two brushrolls is less than 3000 r/min;

a fluid distributor, configured to distribute cleaning liquid to a surface of the at least two brushrolls; and a wiper unit corresponding to each of the at least two brushrolls, each wiper unit comprising a stain sub-wiper, configured to wipe off the cleaning liquid or the stains remaining on a circumference of each respective brushroll, and a liquid retaining sub-wiper, configured to enable each respective brushroll to fully contact the cleaning liquid, wherein a hardness of the stain sub-wiper is greater than a hardness of the liquid retaining sub-wiper wherein as the at least two brushrolls rotate from a contact position with the surface to be cleaned, stains and dirty water attached to the at least two brushrolls are first wiped off by the respective stain sub-wiper, and clean cleaning liquid flowing to the at least two brushrolls is then wiped by the respective liquid retaining sub-wiper, and wherein the fluid distributor distributes cleaning liquid to each of the at least two brushrolls between the respective stain sub-wiper and liquid retaining sub-wiper.

* * * * *